US007168173B2

(12) United States Patent
Worrick, III

(10) Patent No.: US 7,168,173 B2
(45) Date of Patent: Jan. 30, 2007

(54) SHAVING SYSTEM

(75) Inventor: Charles B. Worrick, III, Hanson, MA (US)

(73) Assignee: The Gillette Company, Boston, MA (US)

( * ) Notice: Subject to any disclaimer, the term of this patent is extended or adjusted under 35 U.S.C. 154(b) by 269 days.

(21) Appl. No.: 10/799,940

(22) Filed: Mar. 11, 2004

(65) Prior Publication Data

US 2005/0198841 A1 Sep. 15, 2005

(51) Int. Cl.
*B26B 21/52* (2006.01)
*B26B 21/14* (2006.01)
*B26B 21/50* (2006.01)

(52) U.S. Cl. ..... 30/527; 30/532

(58) Field of Classification Search ..... 30/526–533, 30/535, 536

See application file for complete search history.

(56) References Cited

U.S. PATENT DOCUMENTS

| | | | | |
|---|---|---|---|---|
| 939,935 | A | | 11/1909 | Wilcox |
| 1,290,664 | A | | 1/1919 | Russell et al. |
| 1,479,690 | A | | 1/1924 | Angst |
| 1,639,441 | A | * | 8/1927 | Spahr ..... 30/529 |
| 1,734,554 | A | | 11/1929 | Behrman |
| 1,777,914 | A | | 10/1930 | Davis |
| 1,821,825 | A | | 9/1931 | Zumwalt |
| 1,853,867 | A | | 4/1932 | Love |
| 1,890,334 | A | | 12/1932 | Muros |
| 1,911,996 | A | | 3/1933 | Gaieman et al. |
| 1,999,060 | A | | 4/1935 | Rydner |
| 2,043,124 | A | | 6/1936 | Smith et al. |
| 2,052,395 | A | | 8/1936 | Giessler |
| 2,078,150 | A | | 4/1937 | Masip et al. |
| 2,083,172 | A | | 6/1937 | Smith |
| 2,094,240 | A | | 9/1937 | Herrick et al. |
| D109,694 | S | | 5/1938 | Berk |
| 2,118,498 | A | | 5/1938 | Drew |
| 2,132,293 | A | | 10/1938 | Harrer |
| 2,141,339 | A | | 12/1938 | Bauerle |
| D126,066 | S | | 3/1941 | Birrell |
| 2,263,885 | A | | 11/1941 | McGauley |
| 2,275,517 | A | | 3/1942 | Fay |
| 2,309,549 | A | | 1/1943 | Swann |
| D137,220 | S | | 2/1944 | Brownback |
| 2,353,599 | A | | 7/1944 | Swann et al. |

(Continued)

FOREIGN PATENT DOCUMENTS

| | | |
|---|---|---|
| CH | 416377 | 6/1966 |

(Continued)

*Primary Examiner*—Boyer D. Ashley
*Assistant Examiner*—Edward Landrum
(74) *Attorney, Agent, or Firm*—Kevin C. Johnson

(57) ABSTRACT

A shaving razor includes a cartridge having a cartridge housing and a handle. The cartridge housing has a front edge, a rear edge and two side edges extending from the front edge to the rear edge. One or more shaving blades are located on the housing and between the front edge and the rear edge. A connecting member is connected to the cartridge housing and includes a deflectable element defining at least a portion of an opening extending through the connecting member. The handle includes a handle interconnect member that includes a protrusion having an enlarged distal end and angled side surfaces extending from the distal end to a base.

9 Claims, 36 Drawing Sheets

U.S. PATENT DOCUMENTS

| | | | | |
|---|---|---|---|---|
| D160,536 | S | | 10/1950 | Reilly |
| 2,593,307 | A | | 4/1952 | Jcobson |
| 2,662,281 | A | | 12/1953 | Cerino |
| 2,704,397 | A | | 3/1955 | Turgi |
| 2,720,695 | A | | 10/1955 | Sabiers |
| 2,807,084 | A | | 9/1957 | Harman |
| 2,837,820 | A | | 6/1958 | Ostrowski |
| 2,848,806 | A | | 8/1958 | Shnitzler et al. |
| 2,863,213 | A | | 12/1958 | Rypysc |
| 2,934,776 | A | | 5/1960 | Clemens |
| 3,061,926 | A | | 11/1962 | Fjeran |
| 3,111,757 | A | | 11/1963 | Dubofsky |
| 3,137,939 | A | | 6/1964 | Waldeck |
| 3,172,202 | A | | 3/1965 | Sooter |
| D204,672 | S | | 5/1966 | Glaberson |
| 3,259,978 | A | | 7/1966 | Weichselbaum |
| 3,299,508 | A | | 1/1967 | Kuhnl |
| 3,358,368 | A | | 12/1967 | Kuhnl |
| 3,383,764 | A | | 5/1968 | Sachs |
| 3,388,831 | A | | 6/1968 | Idansom |
| 3,391,458 | A | | 7/1968 | Karr |
| 3,412,465 | A | | 11/1968 | Andersen |
| 3,413,720 | A | | 12/1968 | Mullen |
| D215,915 | S | | 11/1969 | Bikien |
| D215,995 | S | | 11/1969 | Harper |
| D216,657 | S | | 2/1970 | Grange |
| D216,658 | S | | 2/1970 | Edmondson |
| D217,752 | S | | 6/1970 | Barry et al. |
| D219,699 | S | | 1/1971 | Poisson |
| 3,593,416 | A | | 7/1971 | Edson |
| 3,600,804 | A | | 8/1971 | Brows |
| 3,626,591 | A | | 12/1971 | Robey |
| 3,685,150 | A | | 8/1972 | Risher |
| 3,703,765 | A | | 11/1972 | Perez |
| D228,315 | S | | 9/1973 | Glaberson |
| 3,795,955 | A | | 3/1974 | Dorian, Jr. |
| 3,795,979 | A | | 3/1974 | Perry |
| 3,810,305 | A | | 5/1974 | Perry |
| 3,823,471 | A | | 7/1974 | Stone |
| D234,648 | S | | 3/1975 | Braginetz |
| D239,060 | S | | 3/1976 | Rees |
| D239,742 | S | | 4/1976 | Rees |
| 3,972,115 | A | | 8/1976 | Ross |
| D241,382 | S | | 9/1976 | Jones |
| 4,017,970 | A | | 4/1977 | Williams |
| 4,270,268 | A | | 6/1981 | Jacobson |
| 4,281,456 | A | | 8/1981 | Douglass et al. |
| 4,285,124 | A | | 8/1981 | Diakonov |
| 4,378,633 | A | | 4/1983 | Jacobson |
| 4,378,634 | A | | 4/1983 | Jacobson |
| D271,531 | S | | 11/1983 | Byrne |
| D271,625 | S | | 11/1983 | Gray |
| 4,442,598 | A | | 4/1984 | Jacobson |
| 4,446,619 | A | | 5/1984 | Jacobson |
| 4,488,357 | A | | 12/1984 | Jacobson |
| 4,492,024 | A | | 1/1985 | Jacobson |
| 4,493,025 | A | | 1/1985 | Bachman et al. |
| 4,498,235 | A | | 2/1985 | Jacobson |
| 4,501,066 | A | | 2/1985 | Sceberras |
| 4,534,110 | A | | 8/1985 | Glass |
| 4,535,537 | A | | 8/1985 | Ferraro et al. |
| 4,551,916 | A | | 11/1985 | Jacobson |
| 4,573,266 | A | | 3/1986 | Jacobson |
| 4,586,255 | A | | 5/1986 | Jacobson |
| 4,621,424 | A | | 11/1986 | Jacobson |
| 4,739,553 | A | * | 4/1988 | Lazarchik ..... 30/47 |
| 4,809,432 | A | | 3/1989 | Schauble |
| 4,831,731 | A | | 5/1989 | Eltis |
| D303,023 | S | | 8/1989 | Sinclair |
| 4,901,437 | A | | 2/1990 | Iten |
| 4,903,405 | A | | 2/1990 | Halvey |
| D306,915 | S | | 3/1990 | Luzenberg |
| D307,334 | S | | 4/1990 | Ferraro et al. |
| D310,889 | S | | 9/1990 | Comcialdi |
| D312,143 | S | | 11/1990 | Schwartz |
| 4,970,784 | A | | 11/1990 | Althaus et al. |
| D313,672 | S | | 1/1991 | Tiegs |
| 4,993,154 | A | | 2/1991 | Radcliffe |
| 5,018,274 | A | | 5/1991 | Trotta |
| D318,142 | S | | 7/1991 | Falchi |
| 5,027,511 | A | | 7/1991 | Miller |
| 5,029,390 | A | | 7/1991 | Reeves |
| 5,033,152 | A | | 7/1991 | Althaus |
| 5,063,667 | A | | 11/1991 | Jacobson |
| 5,067,238 | A | | 11/1991 | Miller et al. |
| 5,113,585 | A | | 5/1992 | Rogers et al. |
| D327,550 | S | | 6/1992 | Chen et al. |
| 5,157,834 | A | | 10/1992 | Chen et al. |
| 5,157,835 | A | * | 10/1992 | Lazarchik et al. ..... 30/533 |
| 5,167,069 | A | | 12/1992 | Quinn |
| 5,199,173 | A | | 4/1993 | Hegemann et al. |
| 5,205,040 | A | | 4/1993 | Werner |
| 5,236,439 | A | | 8/1993 | Kozikowski |
| 5,269,062 | A | | 12/1993 | Dallaire et al. |
| D343,026 | S | | 1/1994 | Dallaire et al. |
| 5,282,814 | A | | 2/1994 | Srivastava |
| D346,042 | S | | 4/1994 | Chu |
| 5,307,564 | A | | 5/1994 | Schoenberg |
| 5,333,383 | A | | 8/1994 | Ferraro |
| 5,351,401 | A | | 10/1994 | Werner |
| D353,020 | S | | 11/1994 | Conti |
| 5,365,881 | A | | 11/1994 | Sporn |
| D363,141 | S | | 10/1995 | Burout et al. |
| 5,454,164 | A | | 10/1995 | Yin et al. |
| 5,458,025 | A | | 10/1995 | Neamtu |
| D364,706 | S | | 11/1995 | Corcoran |
| D369,437 | S | | 4/1996 | Armbruster et al. |
| 5,522,137 | A | | 6/1996 | Andrews |
| 5,526,567 | A | | 6/1996 | Carson, III et al. |
| 5,533,263 | A | | 7/1996 | Gilder |
| 5,560,106 | A | | 10/1996 | Armbruster et al. |
| 5,575,068 | A | | 11/1996 | Pedersen |
| 5,579,580 | A | | 12/1996 | Althaus et al. |
| 5,661,907 | A | | 9/1997 | Apprille, Jr. |
| 5,687,485 | A | | 11/1997 | Shurtleff et al. |
| 5,701,788 | A | | 12/1997 | Wilson et al. |
| 5,704,127 | A | | 1/1998 | Cordio |
| D392,417 | S | | 3/1998 | Gray |
| D392,418 | S | | 3/1998 | Gray |
| 5,761,814 | A | | 6/1998 | Anderson et al. |
| D396,129 | S | | 7/1998 | Gray |
| 5,784,790 | A | | 7/1998 | Carson, III et al. |
| D397,512 | S | | 8/1998 | Gray |
| 5,787,586 | A | | 8/1998 | Apprille, Jr. et al. |
| 5,794,354 | A | | 8/1998 | Gilder |
| 5,813,293 | A | | 9/1998 | Apprille, Jr. et al. |
| 5,822,869 | A | | 10/1998 | Metcalf et al. |
| D403,112 | S | | 12/1998 | Engel |
| D404,527 | S | | 1/1999 | Gray |
| 5,855,071 | A | | 1/1999 | Apprille, Jr. et al. |
| 5,865,189 | A | | 2/1999 | Andrews |
| D406,393 | S | | 3/1999 | Gray |
| D407,849 | S | | 4/1999 | Gray |
| D407,850 | S | | 4/1999 | Shurtleff |
| D407,851 | S | | 4/1999 | Shurtleff |
| D408,101 | S | | 4/1999 | Shurtleff |
| 5,890,296 | A | * | 4/1999 | Metcalf et al. ..... 30/526 |
| 5,915,791 | A | | 6/1999 | Yin et al. |
| 5,918,369 | A | | 7/1999 | Apprille, Jr. et al. |
| 5,956,851 | A | * | 9/1999 | Apprille et al. ..... 30/47 |
| D416,108 | S | | 11/1999 | Shurtleff et al. |
| D416,646 | S | | 11/1999 | Pinchuk |
| D417,034 | S | | 11/1999 | Shurtleff |
| 6,009,624 | A | | 1/2000 | Apprille, Jr. et al. |

| | | | | |
|---|---|---|---|---|
| 6,026,577 | A | 2/2000 | Ferraro | |
| 6,029,354 | A | 2/2000 | Apprille, Jr. et al. | 30/47 |
| D422,117 | S | 3/2000 | Motta | |
| 6,035,537 | A | 3/2000 | Apprille, Jr. et al. | |
| 6,044,542 | A | 4/2000 | Apprille, Jr. et al. | |
| 6,052,903 | A | 4/2000 | Metcalf et al. | |
| 6,085,426 | A | 7/2000 | Metcalf et al. | |
| RE36,816 | E | 8/2000 | Apprille, Jr. et al. | |
| D429,034 | S | 8/2000 | Shurtleff | |
| D431,680 | S | 10/2000 | Wagstaff | |
| 6,141,875 | A | 11/2000 | Andrews | |
| 6,145,201 | A | 11/2000 | Andrews | |
| 6,185,823 | B1 | 2/2001 | Brown et al. | |
| 6,192,586 | B1 | 2/2001 | Metcalf et al. | |
| 6,212,777 | B1 | 4/2001 | Gilder et al. | |
| 6,216,345 | B1 | 4/2001 | Andrews | |
| 6,237,232 | B1 | 5/2001 | Petricca et al. | |
| D444,267 | S | 6/2001 | Gray | |
| D445,958 | S | 7/2001 | Dansreau et al. | |
| D446,884 | S | 8/2001 | Kohring et al. | |
| 6,272,061 | B1 | 8/2001 | Kato et al. | |
| 6,276,061 | B1 * | 8/2001 | Rozenkranc | 30/34.1 |
| D458,410 | S | 6/2002 | Shepperson | |
| 6,418,623 | B1 | 7/2002 | Marcarelli | |
| 6,449,849 | B1 | 9/2002 | Hackerman | |
| D467,387 | S | 12/2002 | Wonderley | |
| 6,502,318 | B1 | 1/2003 | Gilder | |
| 6,526,660 | B1 | 3/2003 | MacNeil | |
| 6,598,303 | B2 | 7/2003 | Bosy et al. | |
| 6,601,272 | B2 | 8/2003 | Stvartak et al. | |
| 6,629,475 | B1 | 10/2003 | Neamtu et al. | |
| 6,651,342 | B1 | 11/2003 | Walker, Jr. | |
| 6,675,479 | B1 | 1/2004 | Walker, Jr. et al. | |
| 2002/0144404 | A1 | 10/2002 | Gilder et al. | |
| 2002/0189112 | A1 * | 12/2002 | Peyser | 30/527 |
| 2003/0014871 | A1 * | 1/2003 | Coffin | 30/532 |
| 2003/0204955 | A1 | 11/2003 | Gilder et al. | |
| 2005/0022386 | A1 | 2/2005 | Macove | |

FOREIGN PATENT DOCUMENTS

| | | | |
|---|---|---|---|
| DE | 206980 | | 2/1908 |
| DE | 1 949 400 | | 8/1970 |
| DE | 36 35 553 | A1 | 10/1986 |
| DE | 3635553 | * | 4/1988 |
| DE | 43 13 371 | | 10/1993 |
| EP | 0 854 017 | A1 | 7/1998 |
| FR | 2 632-886 | | 12/1989 |
| GB | 548648 | | 10/1942 |
| GB | 1 587 317 | | 4/1981 |
| GB | 1 591 095 | | 6/1981 |
| JP | 49-76885 | | 7/1974 |
| JP | 56-43984 | | 4/1981 |
| JP | 3-88467 | | 4/1991 |
| JP | 4-83176 | | 7/1992 |
| JP | 7-506503 | | 7/1995 |
| JP | 52-137991 | | 10/1997 |
| NL | 7603885 | | 10/1977 |
| WO | WO 94/11163 | | 5/1994 |
| WO | WO 96/01171 | | 1/1996 |
| WO | WO 97/37818 | | 10/1997 |
| WO | WO 97/37819 | | 10/1997 |
| WO | WO 98/05478 | | 2/1998 |
| WO | WO 99/14020 | | 3/1999 |
| WO | WO 00/16951 | | 3/2000 |

* cited by examiner

SHAVING SYSTEM

BACKGROUND

The invention relates to shaving assemblies.

In recent years shaving razors with various numbers of blades have been proposed in the patent literature as described, e.g., in U.S. Pat. No. 5,787,586, which generally describes a razor with a handle and cartridge connected thereto, and commercialized as the three-bladed Mach III razor by The Gillette Company.

SUMMARY

In one aspect, the invention features a shaving razor that includes a cartridge having a cartridge housing and a handle. The cartridge housing has a front edge, a rear edge and two side edges extending from the front edge to the rear edge. One or more shaving blades are located on the housing and between the front edge and the rear edge. A connecting member is connected to the cartridge housing and includes a deflectable element defining at least a portion of an opening extending through the connecting member. The handle includes a handle interconnect member that includes a protrusion having an enlarged distal end and angled side surfaces extending from the distal end to a base. The enlarged distal end of the protrusion having a dimension greater than a dimension of the opening such that inserting the protrusion deflects the deflectable element to secure the connecting member to the handle interconnect member.

Implementations can include a trimming assembly connected to the housing. In some embodiments, the trimming assembly includes a trimming blade. In some cases, the connecting member is configured such that the trimming blade can be guided along a skin surface using the handle for a trimming operation.

In another aspect, the invention features a shaving assembly including a housing having a front edge and a rear edge. One or more shaving blades are located between the front edge and the rear edge of the housing. Connected to the housing is a trimming assembly that includes a trimming blade. A connecting member connected to the housing is configured to releasably connect the housing to a razor handle.

In another embodiment, the invention features a shaving razor that includes a connecting member, a cartridge housing pivotally connected to the connecting member and a handle connected to the connecting member. The housing and connecting member including pivot structure forming a pivot axis to allow rotation of the cartridge housing relative to the connecting member. The cartridge housing has a front edge and a rear edge and including a cam surface. One or more shaving blades are located between the front edge and the rear edge of the cartridge housing. The handle has a plunger biased toward the cartridge housing with the plunger contacting the cam surface a horizontal distance of no less than about 0.8 mm from the pivot axis.

In some implementations, the plunger contacts the cam surface a direct distance from the pivot axis of at least about 2.5 mm. The one or more blades can be located at a rear portion of the cartridge housing, the rear portion defined between the pivot axis and the rear edge of the cartridge housing. In some case, the horizontal distance varies as the housing is rotated relative to the connecting member, such as from a minimum distance of about 0.8 mm or more to a maximum distance of about 3.5 mm or less. In some embodiments, a direct distance of a point of contact between the plunger and the cam surface from the pivot axis varies from a minimum of about 3 mm or more to a maximum of about 5 mm or less.

In some embodiments, the plunger applies a biasing force to the housing to achieve a torque at the pivot axis of at least about 1.5 N-mm. In certain cases, the plunger applies a biasing force to the housing to achieve a torque at the pivot axis of between about 1.5 N-mm and 6 N-mm, such as about 3.5 N-mm.

In certain implementations, an elastomeric member is secured to the housing assembly. The elastomeric member may include a fin.

In some cases, a clip retains the one or more blades on the housing. A leg of the clip may be received by an aperture formed by the housing and located between the front and rear edges.

In some embodiments, the connecting member is configured such that the trimming blade can be guided along a skin surface using the handle for a trimming operation. In some cases, the connecting member is connected to the housing and includes a deflectable element defining at least a portion of an opening extending through the connecting member. The connecting member can include a pair of opposing deflectable elements that define at least a portion of an opening extending through the connecting member. In some cases, the handle comprises a handle interconnect member including a protrusion sized to be received by the opening. In some embodiments, the protrusion has an enlarged distal end and angled side surfaces extending from the distal end to a base, the enlarged distal end of the protrusion having a dimension greater than a dimension of the opening such that inserting the protrusion into the opening deflects the deflectable elements to secure the connecting member to the handle interconnect member. The protrusion can have angled side surfaces that have a projected apex angle of between about 45 and 60 degrees, such as about 52 degrees.

In many embodiments, a plunger extends through an opening defined by the handle interconnect member and extending through the protrusion, the plunger configured to contact a surface of the cartridge housing. In some cases, the connecting member provides pivot structure defining a pivot axis for pivoting of the housing with respect to the connecting member. The plunger can be spring biased in a direction toward the housing.

In some embodiments, a movable pusher is configured to disengage the connecting member and the interconnect member. The pusher can be configured to contact the connecting member to disengage the connecting member and the handle interconnect member includes an aperture for slidably receiving the pusher. In some cases, the aperture is spaced from the protrusion. In some embodiments, the pusher is configured to contact the deflectable element to disengage the deflectable element from the side surface of the protrusion. The pusher can be spring-biased away from the connecting member. In certain cases, the pusher extends from an ejector button. The button can include a button substrate with the pusher extending integrally therefrom. In some embodiments, the pusher comprises a pair of arms. The ejector button can also be spring-biased.

In some embodiments, a handle is releasably attached to the cartridge. In other cases, a handle is permanently attached to the cartridge, e.g., to form a disposable razor.

Aspects can include one or more of the following advantages. The connection formed between the connecting member and the handle can secure the cartridge to the handle for use during a trimming operation using a trimming assembly. The connecting member can be easily disengaged from the handle by actuating the release button, which causes the pusher to engage the connecting member. Increasing spacing of the contact point between the plunger and the housing from the pivot axis tends to provide leverage for biasing the blade unit toward its rest, spring-biased position.

Other advantages and features of the invention will be apparent from the following description of particular embodiments and from the claims.

DETAILED DESCRIPTION

Figure 1:
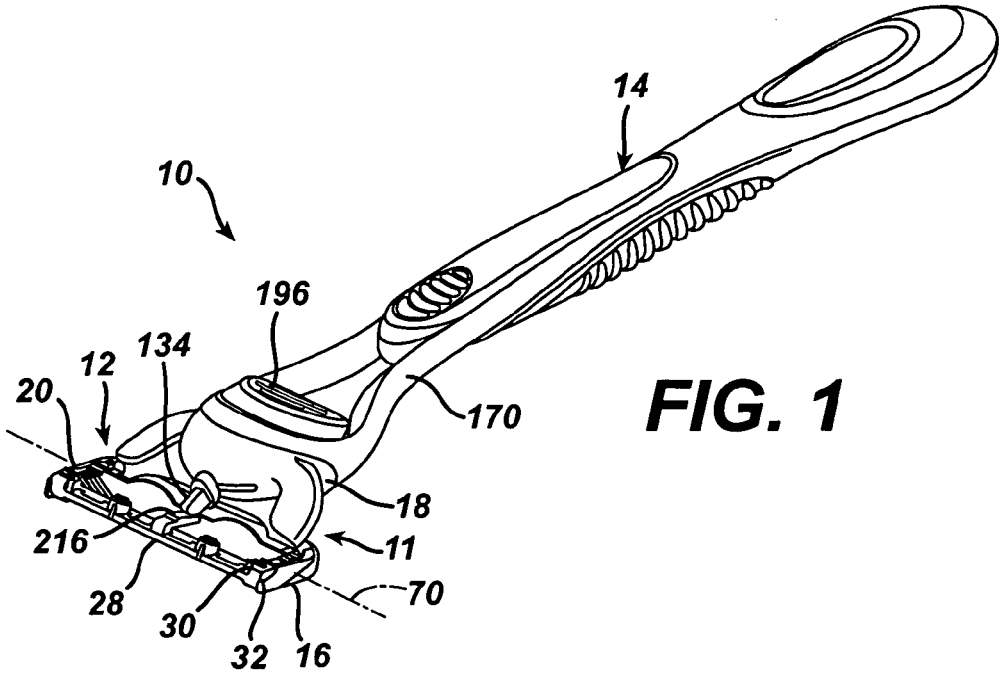
FIG. 1 is a perspective view of a razor.
Figure 2:
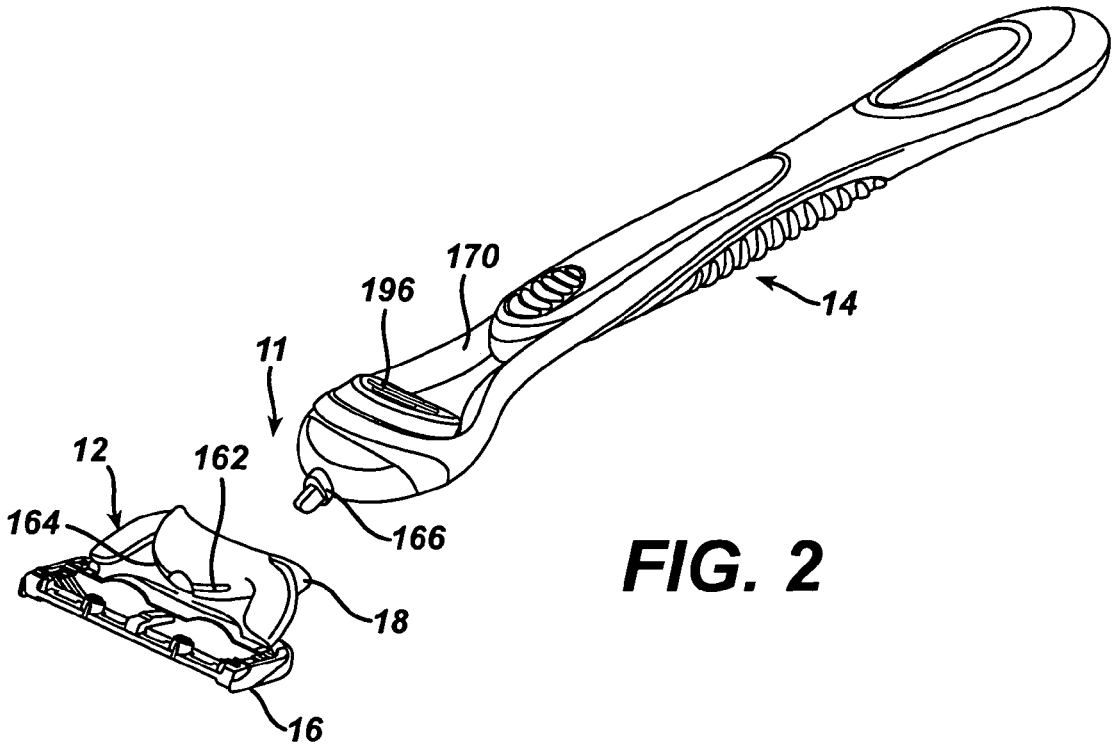
FIG. 2 is a perspective view of the razor of FIG. 1 with the cartridge disconnected from the handle.
Figure 2A:
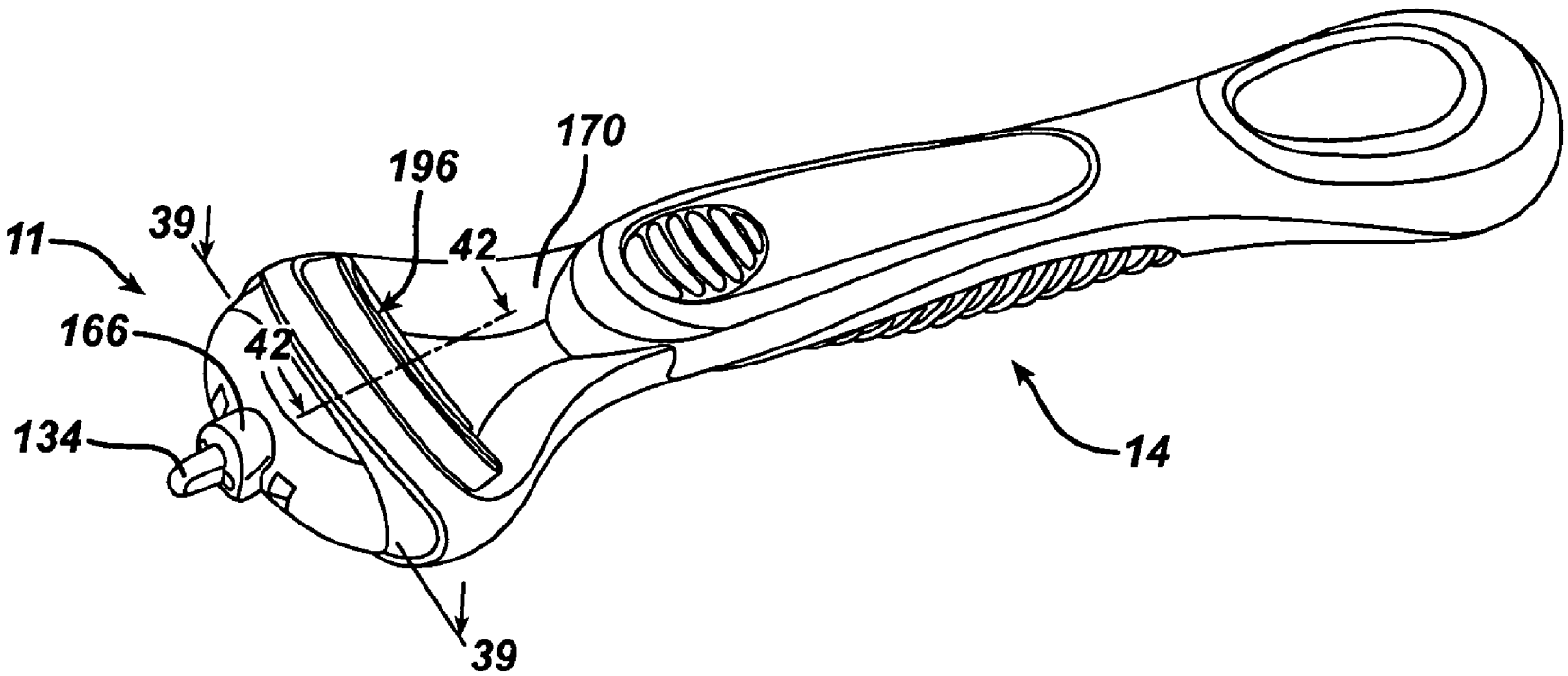
FIG. 2A is a perspective view of the handle of FIG. 2.
Figure 3:
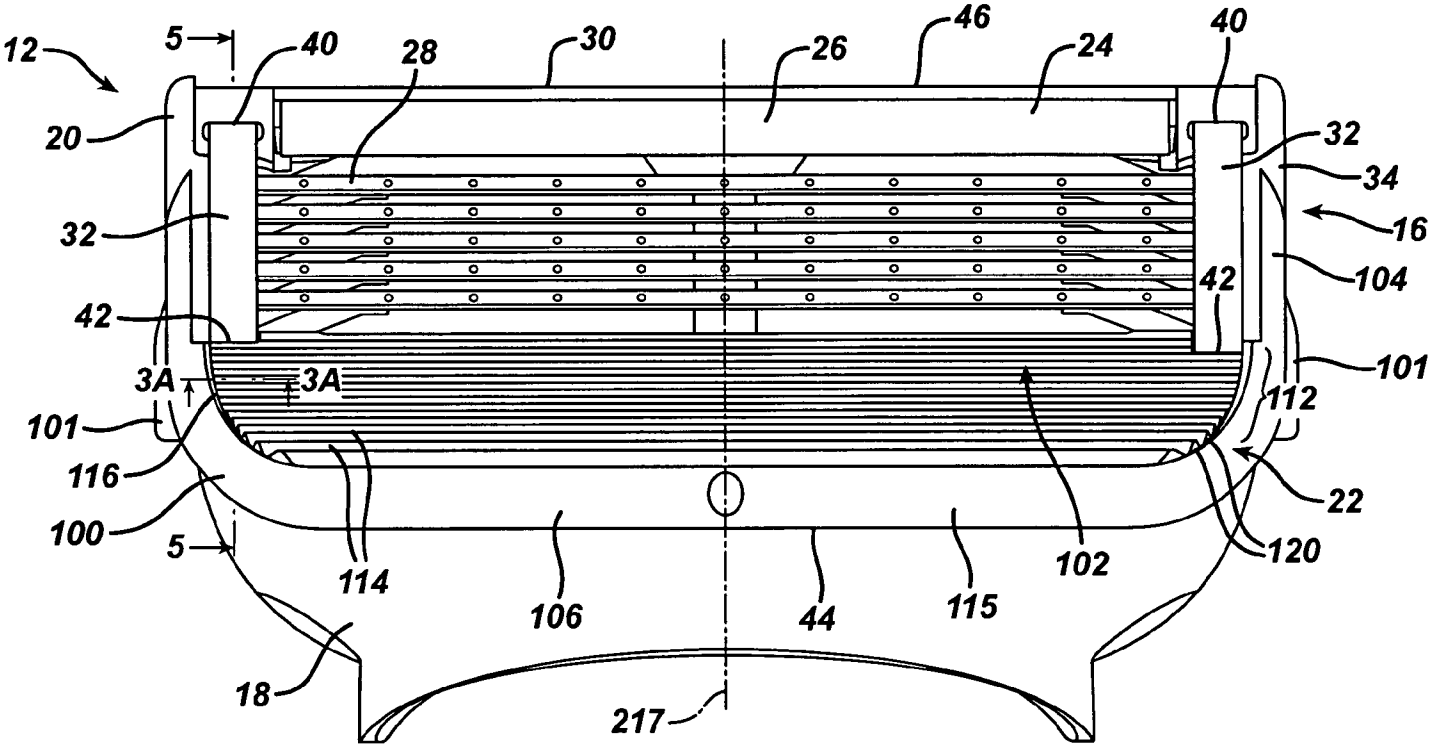
FIG. 3 is a front view of the cartridge of FIG. 2.
Figure 3A:
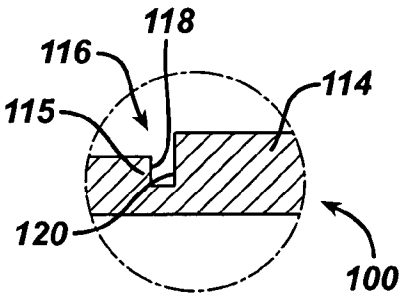
FIG. 3A is a sectional view of an elastomeric member of FIG. 3 taken along line A—A in FIG. 3.
Figure 3B:
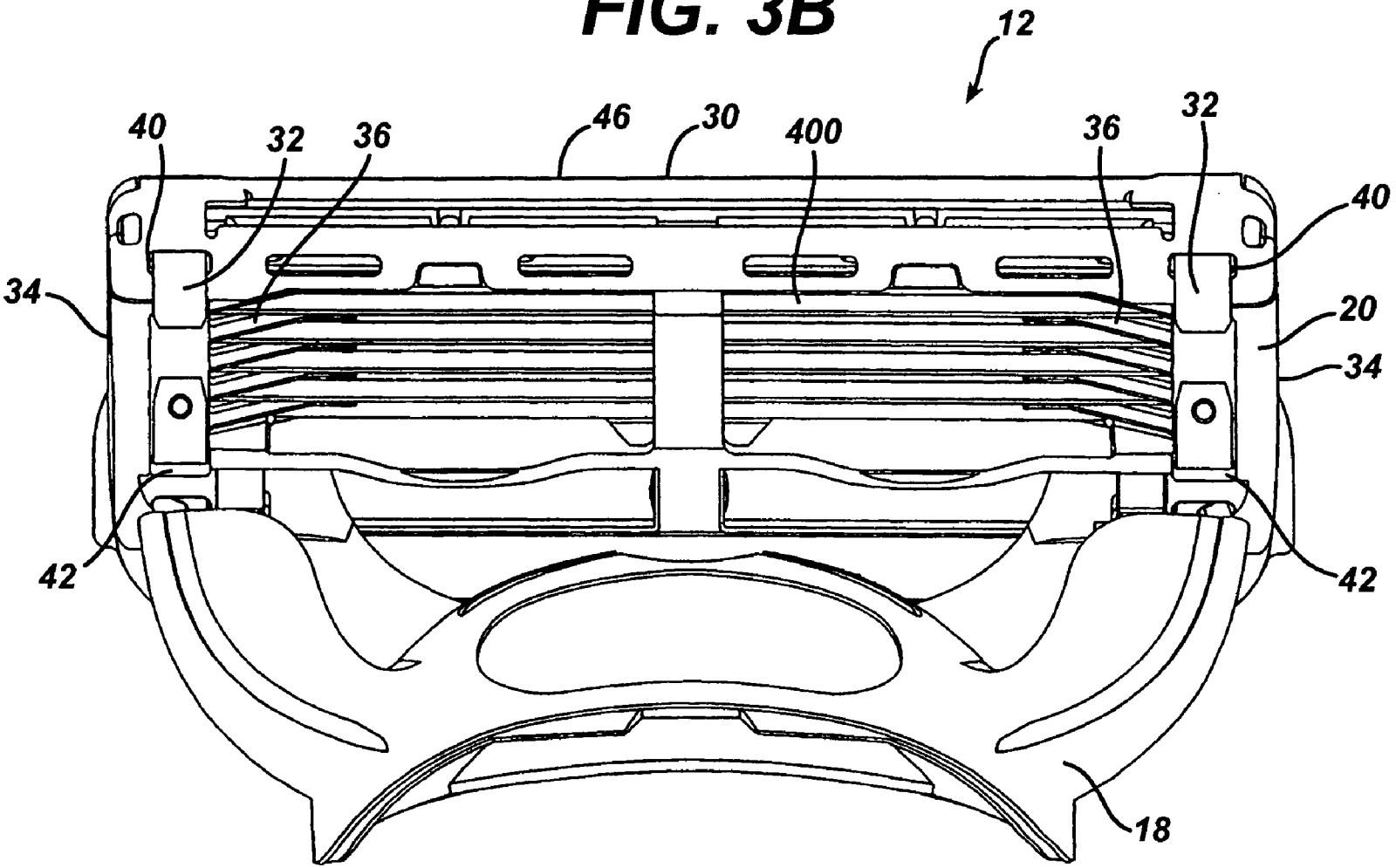
FIG. 3B is a rear view of the cartridge of FIG. 3.
Figure 3C:
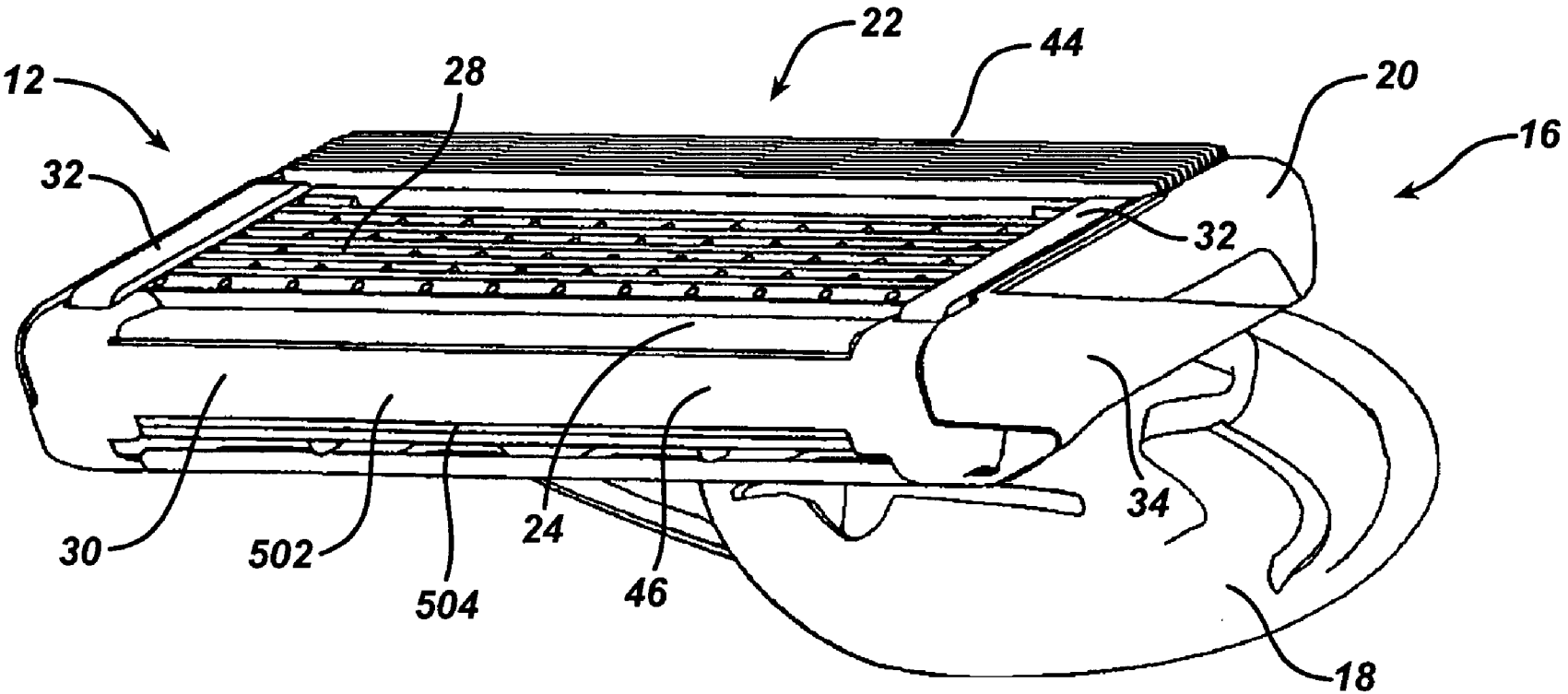
FIGS. 3C and 3D are perspective views of the cartridge of FIG. 3.
Figure 3D:
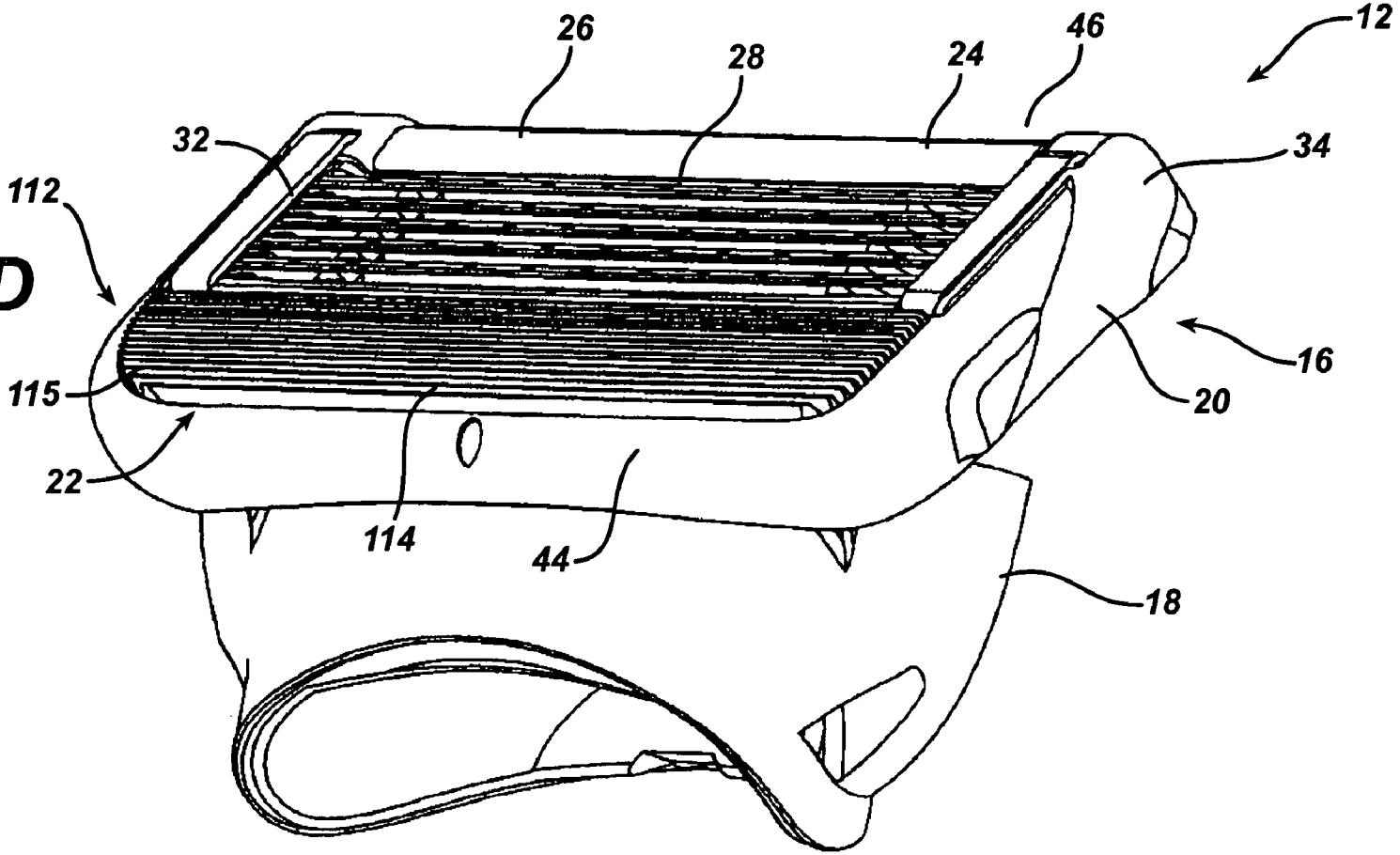

Referring to FIGS. 1 and 2 shaving razor 10 includes disposable cartridge 12 and handle 14 (FIG. 2A). Cartridge 12 includes a connecting member 18, which removably connects cartridge 12 to handle 14, and a blade unit 16, which is pivotally connected to connecting member 18. Referring also to FIGS. 3, 3C and 3D, the blade unit 16 includes plastic housing 20, guard 22 at the front of housing 20, cap 24 with lubricating strip 26 at the rear of housing 20, five blades 28 between guard 22 and cap 24, and trimming blade assembly 30 (FIG. 3C) attached to the rear of housing 20 by clips 32, which also retain blades 28 within housing 20.

Figure 4:
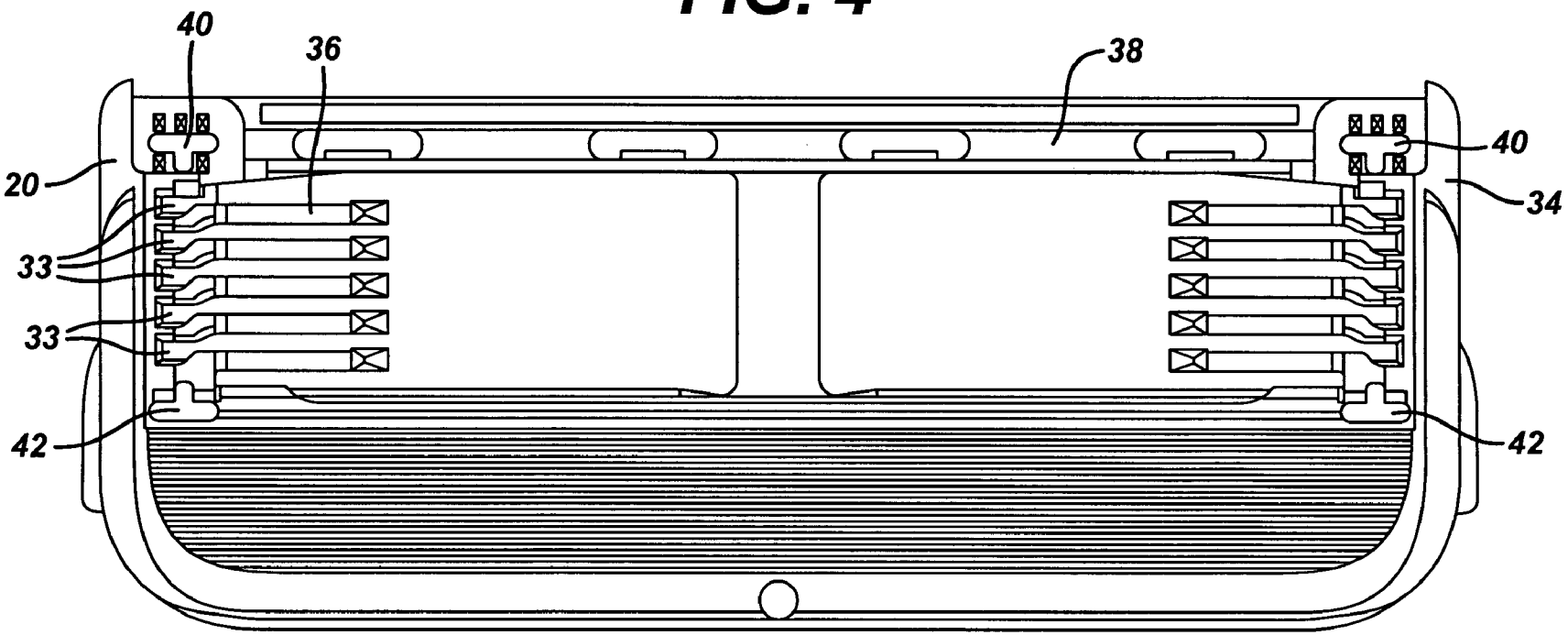
FIG. 4 is a front view of a cartridge housing including an elastomeric member.
Figure 7:
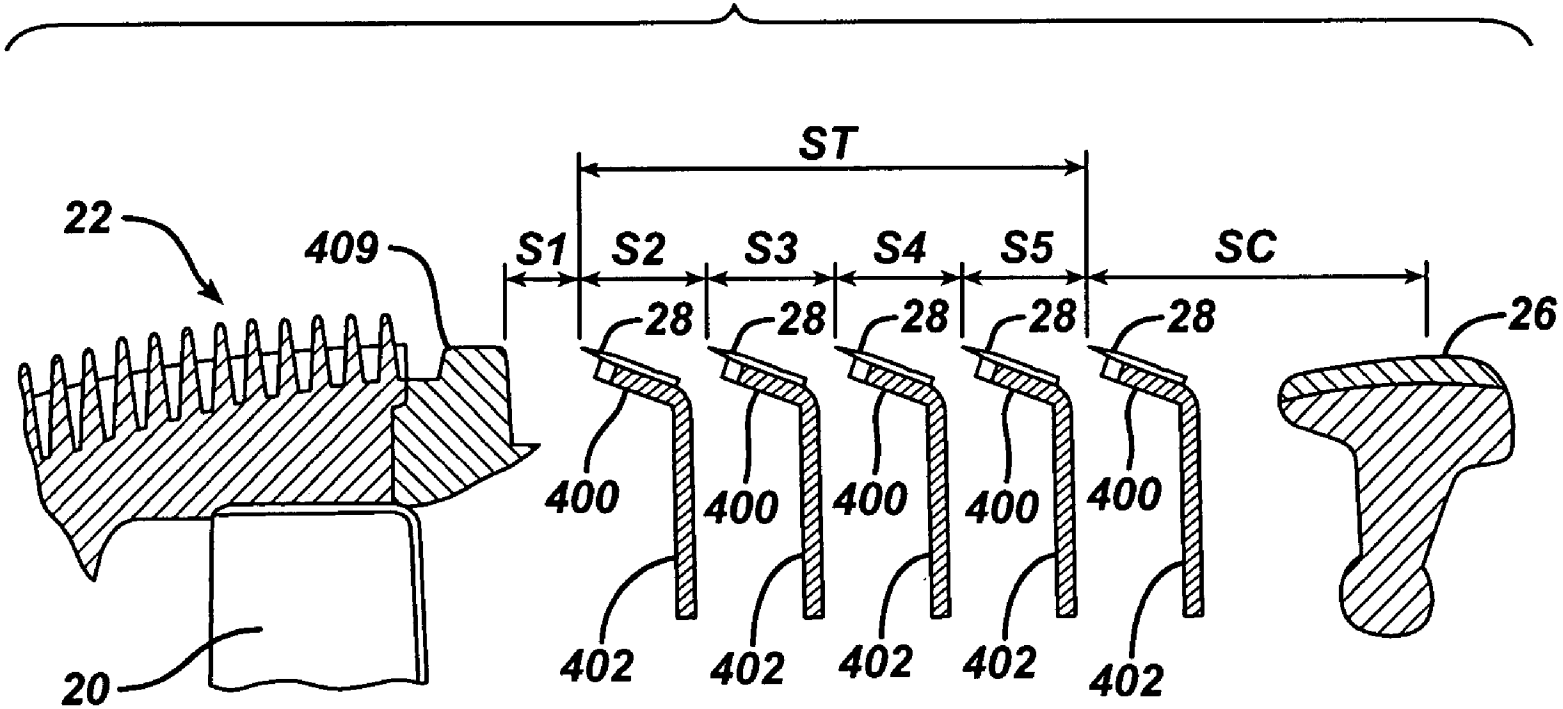
FIG. 7 is vertical sectional view showing the relative positions of some of the components of a cartridge of the FIG. 1 razor.
Figure 8:
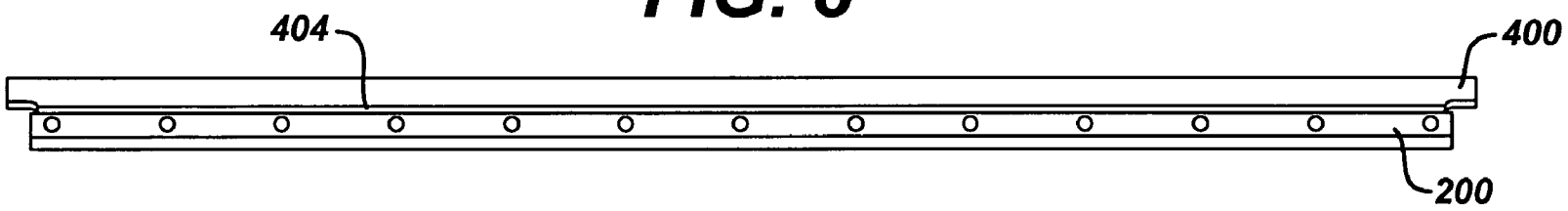
FIG. 8 is a top view of a cutting member of the FIG. 3 cartridge.
Figure 9:
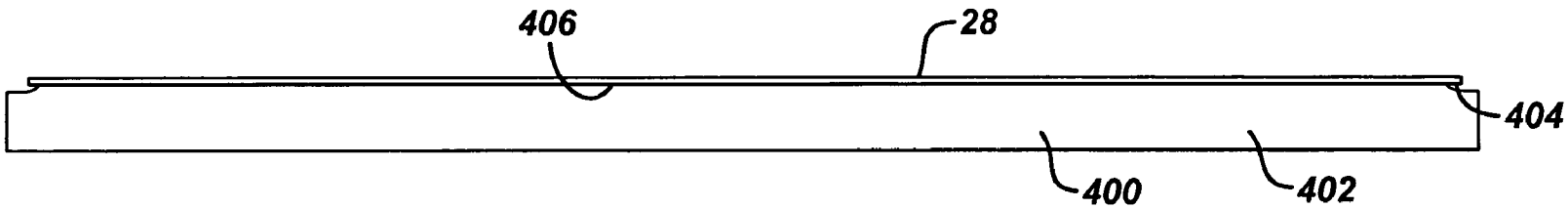
FIG. 9 is a front view of the FIG. 8 cutting member.
Figure 10:
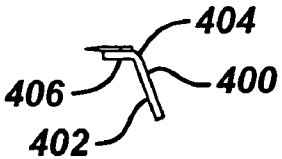
FIG. 10 is a vertical sectional view of the FIG. 8 cutting member.
Figure 11:
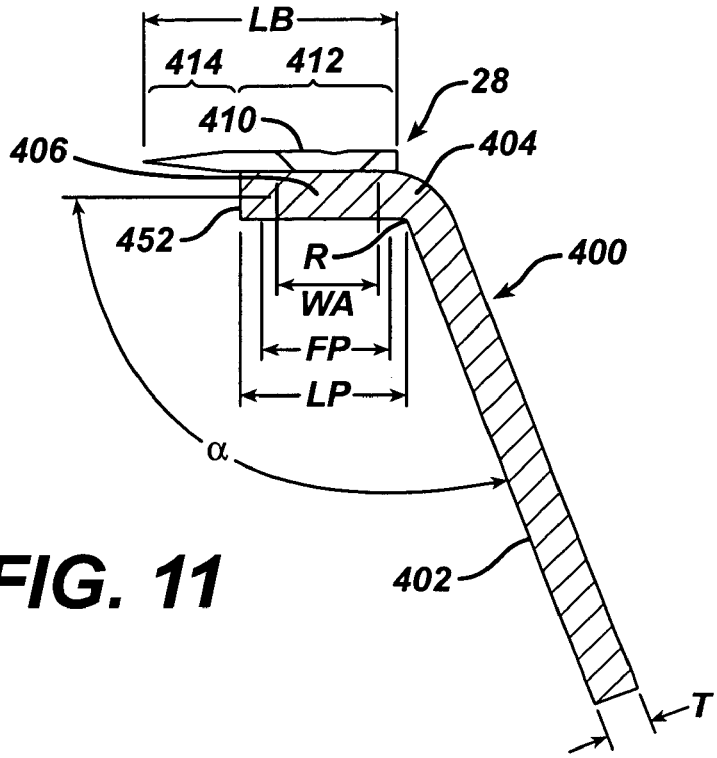
FIG. 11 is an enlarged vertical sectional view of the FIG. 8 cutting member.
Figure 12:
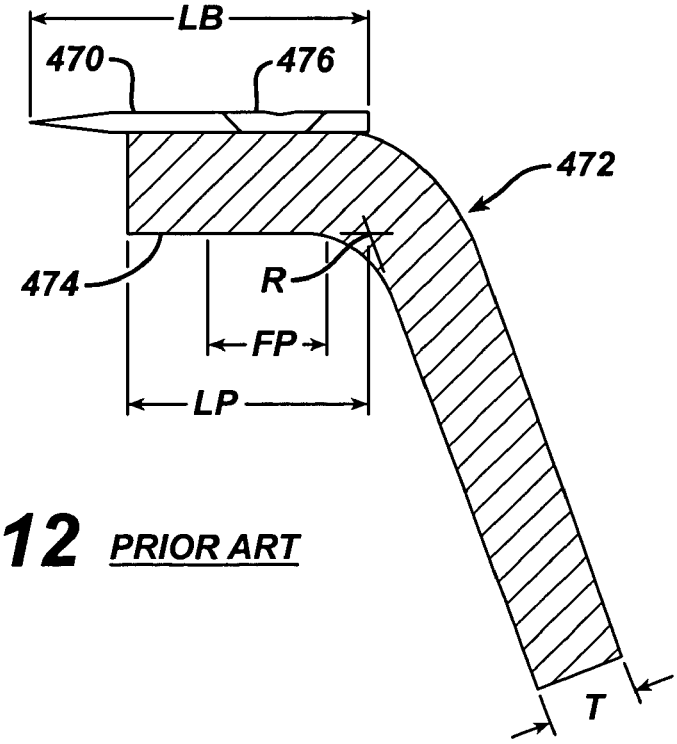
FIG. 12 PRIOR ART
FIG. 12 is a vertical sectional view of a prior art cutting member.

Referring to FIG. 4, which shows blade unit 16 with the blades removed, housing 20 of blade unit 16 has inwardly facing slots 33 in side walls 34 for receiving ends of blade supports 400 (see FIG. 7). Housing 20 also has respective pairs of resilient arms 36, extending from the side walls, on which each blade 28 is resiliently supported. Blades 28 are located in a relatively unobstructed region between the side walls 34, e.g., to provide for ease of rinsing of the cartridge during use.

Referring back to FIG. 3, cap 24 provides a lubricious shaving aid and is received in slot 38 (FIG. 4) at the rear of housing 20. Cap 24 may be made of a material comprising a mixture of a hydrophobic material and a water leachable hydrophilic polymer material, as is known in the art and described, e.g., in U.S. Pat. Nos. 5,113,585 and 5,454,164, which are hereby incorporated by reference.

In-Board Clips

Referring to FIGS. 3, 3B, 3C and 3D, clips 32 are secured near respective sides of housing 20 and inside side walls 34. Each clip 32 passes through a pair of slots 40 and 42 (FIG. 4) located between front edge 44 and rear edge 46 of the blade unit 16 (see also FIG. 4). Preferably, clips 32 are formed of 5052-H16 Aluminum and are about 0.3 mm thick. As will be described in greater detail below, by locating the clips 32 in-board of the front and rear edges 44, 46 of blade unit 16, the clips interfere less with certain shaving features of the razor 10. Additionally, by threading the clips 32 through slots 40 and 42 in the housing 20 and bending legs 50 and 52 (see FIG. 5) to a desired curvature, the clips 32 may be very securely mounted on the housing 20.

Figure 5:
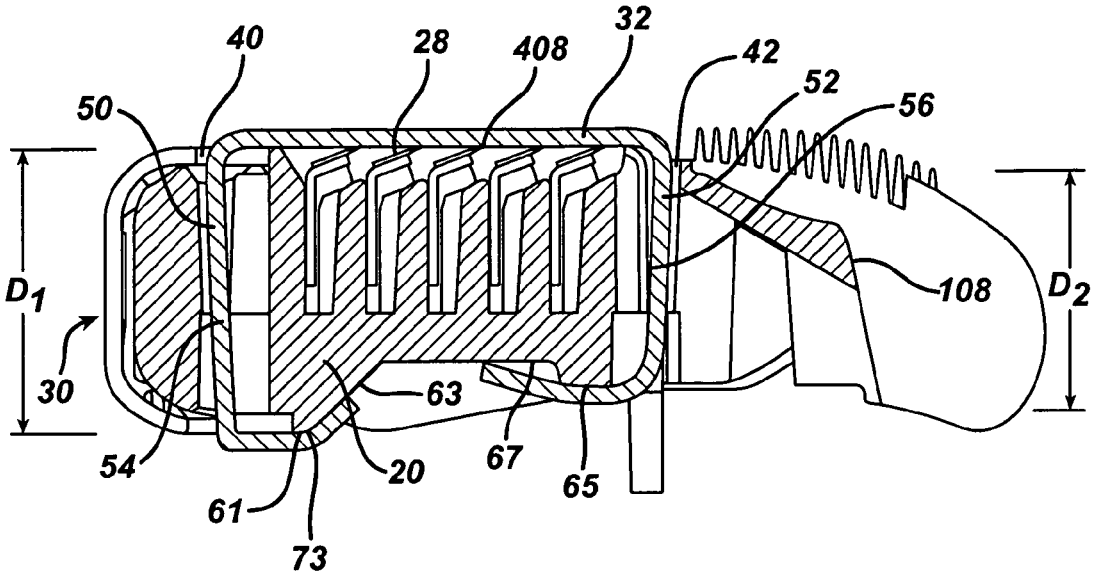
FIG. 5 is a sectional view of the cartridge of FIG. 3 taken along line 5—5 in FIG. 3.

Referring now to FIG. 5, the clips 32, as noted above, retain the blades 28 within housing 20. The clips 32 also locate cutting edges 408 of the spring-biased blades 28 at a desired exposure when in the rest position. Legs 50 and 52 of the clips 32 are threaded through the slots 40 and 42, respectively, and wrap around the bottom of the housing 20.

Figure 6:
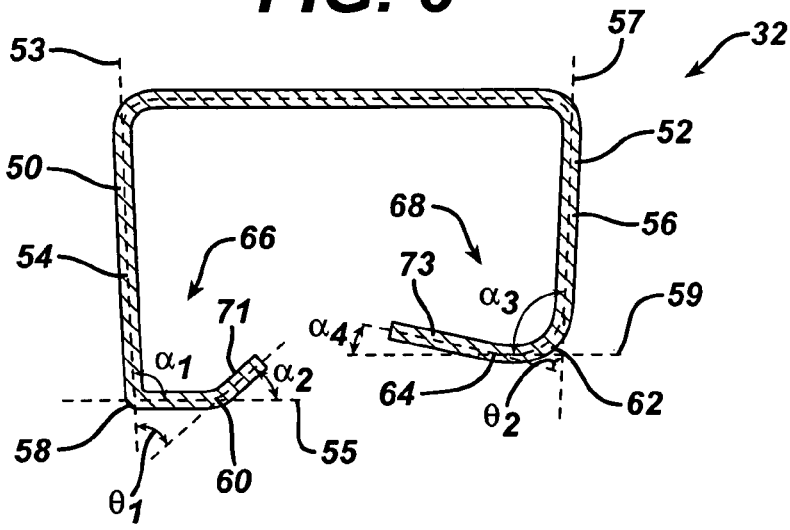
FIG. 6 is a sectional view of the clip of FIG. 5.

As can be seen in FIG. 5, the distance $D_1$ which leg 50 is threaded through housing 20 is greater than the distance $D_2$ which leg 52 is threaded through the housing. This is due, in part, to trimming blade assembly 30 being located at the rear of the housing 20 and being also secured to the housing 20 by the clips 32. Referring now to FIG. 6, legs 50 and 52 include relatively straight portions 54, 56 extending through the housing 20 and multiple bends 58, 60, 62, 64 forming relatively bent portions 66, 68 (e.g., by crimping metallic clips over surfaces 61, 63, 65, 67 and beyond their elastic limit). The bends 58, 60, 62 and 64 impart a desired curvature to the legs 50 and 52 of the clips 32, generally corresponding to the shape of the housing 20. The discontinuous nature of the curvature of the legs 50 and 52 tends to inhibit straightening out of the legs. As shown, $\alpha_1$ (measured from vertical 53) is between about 91 and 93 degrees, e.g., about 92.2 degrees, $\alpha_2$ (measured from horizontal 55) is between about 42 and 44 degrees, e.g., about 43 degrees, $\alpha_3$ (measured from vertical 57) is between about 91 and 94 degrees, e.g., about 92.4 degrees and $\alpha_4$ (measured from horizontal 59) is between about 19 and 22 degrees, e.g., about 20.4 degrees. The curvature of a leg is defined herein as the sum of the angles $\alpha$ of the individual bends. Because the sum of $\alpha_1$ and $\alpha_2$ is greater than the sum of $\alpha_3$ and $\alpha_4$, leg 50 has a greater curvature than leg 52. Both legs 50 and 52, however, have a curvature of greater than 90 degrees. As shown, leg 50 has a curvature (i.e., $\alpha_1$ plus $\alpha_2$) of about 135 degrees (preferably between about 91 and 150 degrees) and leg 52 has a curvature (i.e., $\alpha_3$ plus $\alpha_4$) of about 113 degrees (preferably between about 91 and 130 degrees). Straight portions 54, 56 and end portions 71 and 73 of the legs 50, 52 form projected angles $\theta$. In the embodiment shown, a smaller $\theta$ is preferable, such as no greater than about 80 degrees. As shown, $\theta_1$ is about 47 degrees and $\theta_2$ is about 70 degrees. The legs 50, 52 can also be overbent to preload the clips 32 against the housing providing added security thereto. For example, in the embodiment shown in FIG. 5, bend 60 applies a slight load to the housing 20 at the contact point 73 between bend 60 and the housing.

Threading clips 32 through the housing and bending legs 50 and 52 can provide several advantages. For example, a wider blade unit 16 can be provided without substantial increase in length of the clips 32, because the clips 32 are positioned inboard of the blade unit's front and rear edges 44, 46. This is in contrast to, e.g., U.S. Pat. No. 6,035,537, which employs metal clips that wrap around the housing's periphery and over front and rear sides of the blade unit. Also, straight portions 54 and 56 of the legs 50 and 52 are relatively enclosed within slots 40 and 42 of the housing 20 and bent over the housing using relatively sharp bends (i.e., bends having a relatively short bend radius). This bend geometry can provide very secure attachment of the clips 32 to the housing 20, making removal of the clips 32 from the slots 40 and 42 difficult without breaking the clip. Additionally, by forming the clips 32 of metal and bending the metal sharply, it can be relatively difficult to straighten the clips sufficiently to pull the bent portions 66, 68 through the slots 40, 42. As another example, an in-board clip arrangement facilitates use of a longer and wider guard, described in greater detail below.

Primary Blades

Referring to FIGS. 7–12, it is seen that each elongated blade 28 is supported on a respective elongated bent support 400 having an elongated lower base portion 402, an elongated bent portion 404 and an elongated platform portion 406 on which the blade 28 is supported. The blade span is defined as the distance from the blade edge to the skin contacting element immediately in front of that edge as measured along a tangent line extending between the element and the blade edge. The cutting edges 406 of each blade are separated from cutting edges 408 of adjacent blades by the inter-blade span distance S2=S3=S4=S5; the inter-blade span is between 0.95 mm and 1.15 mm, preferably between 1.0 mm and 1.1 mm and most preferably about 1.05 mm. The blade exposure is defined to be the perpendicular distance or height of the blade edge measured with respect to a plane tangential to the skin contacting surfaces of the blade unit elements next in front of and next behind the edge. Because the cutting edges all rest against clips 32 when at rest, they are in a common plane, such that the exposures of the three intermediate blades are zero. The front blade 28 has a negative exposure of −0.04 mm, and the last blade 28 has a positive exposure. The decreased exposure on the first blade and increased exposure on the last blade provides for improved shaving performance as described in U.S. Pat. No. 6,212,777. The span S1 from the front rail 409 to the cutting edge of the front blade 28 is 0.65 mm, and the distance SC from the cutting edge of the last blade 28 to the tangent point on lubricating strip 26 of cap 24 is 3.16 mm.

The increased number of blades tends to desirably distribute compressive forces of the blades against the skin, but will increase the area taken up by the blades if the spans remain the same, with potential difficulties in maneuverability and trimming. Reducing spans for an increased number of blades tends to desirably reduce the overall area taken up by blades and to reduce the bulge of skin between cutting edges with a potential improvement in comfort. Reducing the span, however, can reduce the rinsability and ability to clear shaving debris from the blade area. In a five-bladed razor, the lower end of the span range of 0.95 mm provides good comfort but increased potential for problems associated with clearing shaving debris, and the upper end of the span range of 1.15 mm provides good clearing of shaving debris but potential for skin bulge and decreased comfort, such that span values within the range, and in particular, values closer to the most preferred 1.05 mm span, provide a good balance of reduced size and good comfort while maintaining sufficient rinsability to avoid shaving debris problems. The distance ST from the first cutting edge 408 to the last cutting edge 408 is four times the inter-blade span and thus is between 3.8 mm and 4.6 mm, preferably between 4.0 mm and 4.4 mm and most preferably about 4.2 mm, i.e., between 4.1 mm and 4.3 mm.

Referring to FIGS 8–11, blade 28 is connected to platform portion 406 by thirteen spot welds 410 applied by a laser that melts the metal of blade 28 at the weld area WA to create molten metal, which forms the weld 410 to platform portion 406 upon cooling. The weld area WA is an area of attachment at which the blade is secured to the platform portion. The weld area WA is located within a flat portion FP of platform portion 406. The blade length LB from cutting edge 408 to blade end 450 is less than 1 mm, preferably less than 0.9 mm, and most preferably about 0.85 mm. Blade 28 has a uniform thickness portion 412 that is supported on platform portion 406 and a tapered portion 412 that extends beyond the front end 452 of platform portion 406.

Elongated bent metal support 400 is made of metal that is between 0.004" and 0.009" thick (dimension T), preferably metal between 0.005" and 0.007" thick, and most preferably metal about 0.006" thick. Platform portion 406 has a length LP length from its front end 452 to the bent portion 404 less than 0.7 mm, preferably less than 0.6 mm, and most preferably about 0.55 mm. The bent portion 404 has an inner radius of curvature R that is less than 0.1 mm, preferably less than 0.09 mm and most preferably less than 0.08 mm. The angle $\alpha$ between base portion 402 and platform portion 406 is between 108 degrees and 115 degrees, preferably between 110 degrees and 113 degrees, most preferably about 111.5 degrees.

Because angled support 400 is cut and formed from thinner metal, it facilitates providing a reduced radius of curvature R, thereby permitting a greater percentage of the platform portion to be flat. The use of thinner material for the support also facilitates the ability to provide a larger percentage of the platform area flat after forming. A minimum size flat area is needed to accurately and reliably support blade 28, which has a reduced length for its uniform thickness portion 412, owing to the shorter length. The shorter uniform thickness portion 412 can be employed, while still maintaining necessary accurate blade support, because the extent of curved areas of platform portion 406 outside of the flat area FA has been reduced. Such accurate blade support is necessary to provide desired blade geometry for desired shaving performance.

Trimming Assembly

Figure 13:
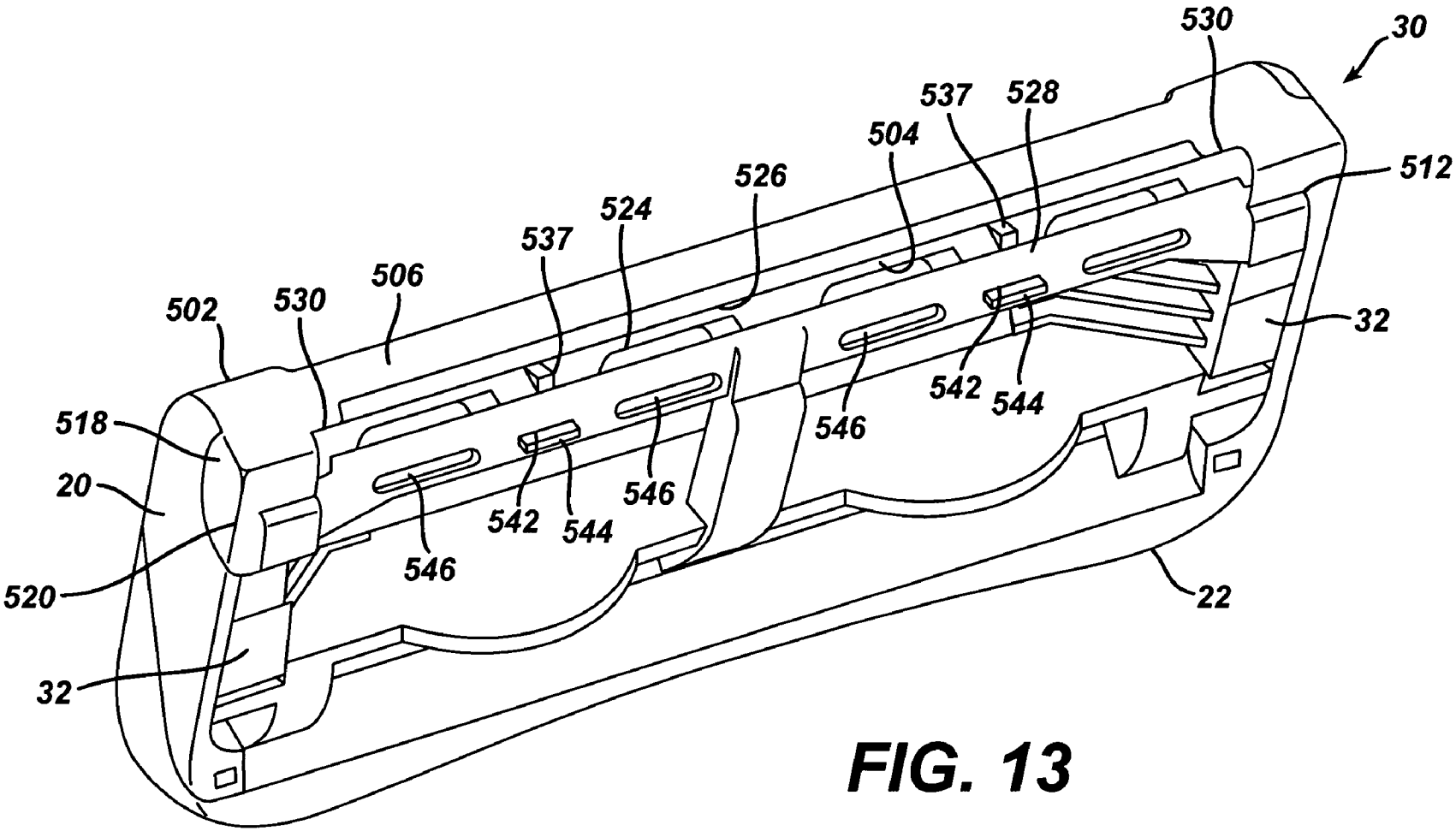
FIG. 13 is a perspective view of a blade unit of the FIG. 1 razor with the primary blades removed.

Referring to FIG. 13, trimming blade assembly 30 is secured to the back of housing 20 and includes blade carrier 502 and trimming blade 504 mounted thereon. Blade carrier 502 is made of 0.011" thick stainless steel sheet metal that has been cut and formed to provide structures for supporting trimming blade 504 and defining a trimming guard and cap surfaces therefore and for attaching to housing 20.

Referring to FIGS. 13–19, blade carrier 502 has rear wall 506, upper tabs 508, 510 bent to extend forward at the two ends from the top of rear wall 506, lower wall 512 bent to extend forward along the length of rear wall 506 at the bottom of rear wall 506, and two lateral side portions 514, 516, each of which is made of a lateral tab 518 bent to extend forward from a respective side at an end of rear wall 506 and a vertical tab 520 bent to extend upward from a respective end of lower wall 512.

The central portion of rear wall 506 is open at its lower portion, providing a gap 522 that is located between lower, terminating surface 526 of rear wall 506 and trimming guard 528, which extends upward from lower wall 512. Two alignment surfaces 530 are positioned a precise distance from the bottom of terminating surface 526 at the two ends of terminating surface 526. Trimming blade 504 is welded to interior surface 532 of rear wall 506 by thirteen spot welds 534 with cutting edge 536 of trimming blade 504 aligned with alignment surfaces 530. All of the edges around gap 524, which will come in contact with the user's skin, are rounded to provide a radius of curvature of 0.2 mm so that the edges will not be felt by the user.

Figure 20:
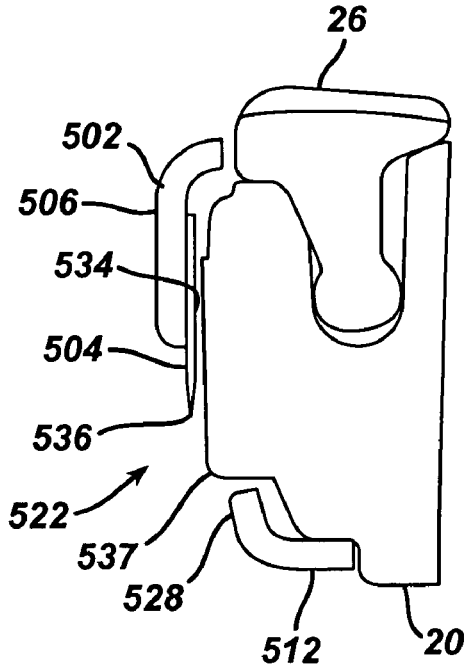
FIG. 20 is a vertical sectional view, taken at 19—19 of FIG. 16, of a portion of the FIG. 3 blade unit.
Figure 21:
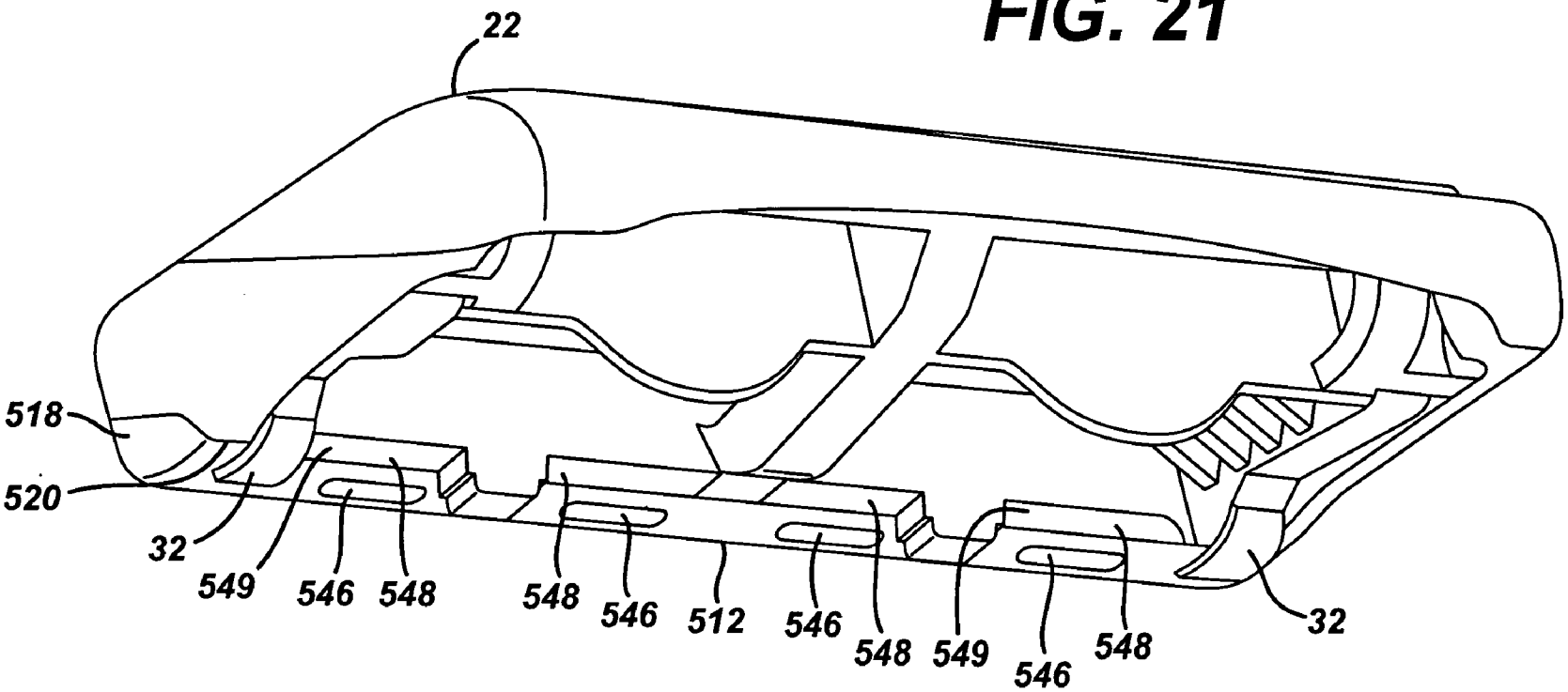
FIG. 21 is a perspective view of the FIG. 3 blade unit with the blades removed.
Figure 22:
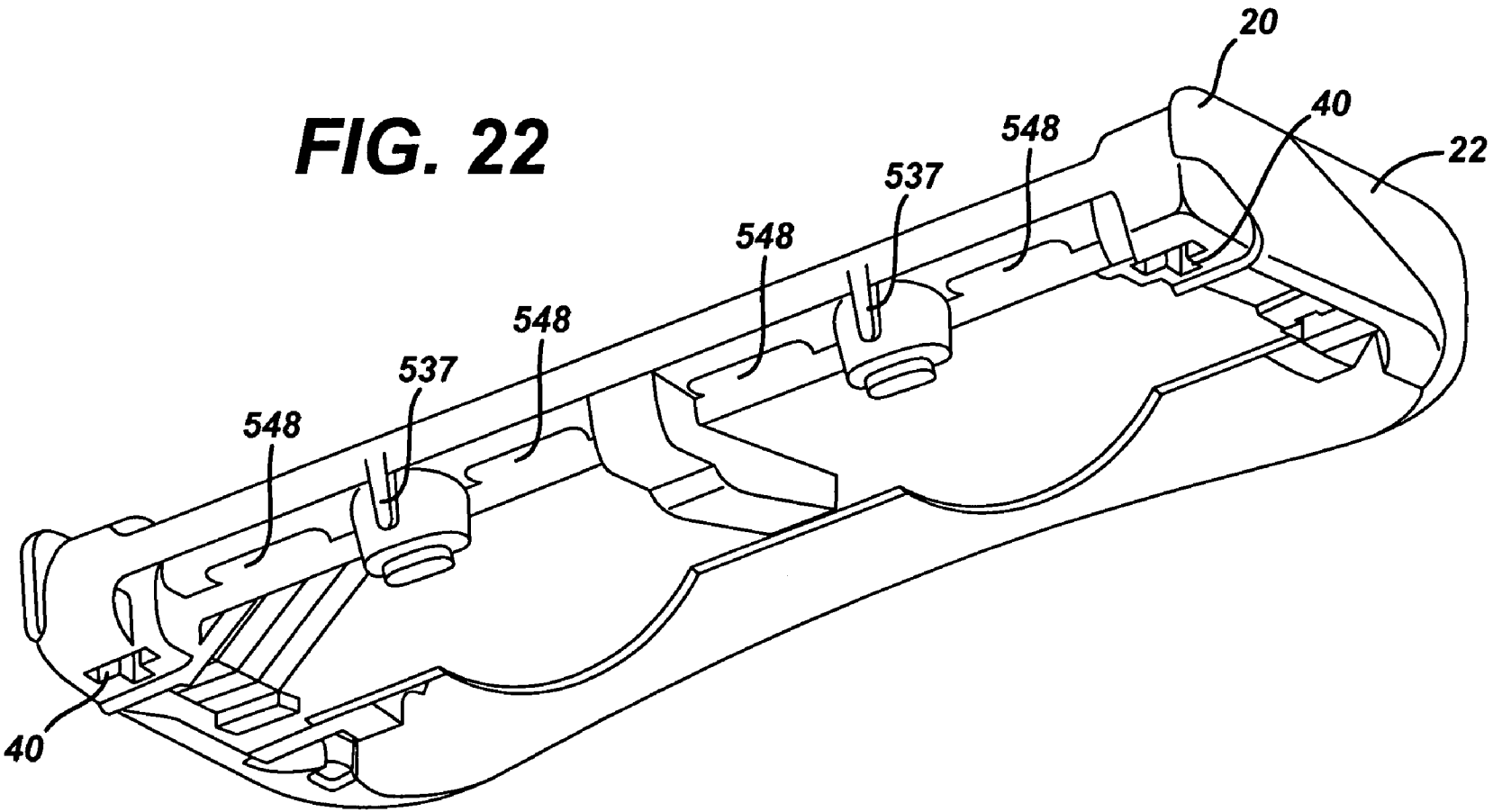
FIG. 22 is a perspective view of the rear of the housing of the FIG. 3 blade unit.

Referring to FIGS. 13, 15–20, gap 522 exposes cutting edge 536 of trimming blade 504. As is perhaps best seen in FIG. 19, rear wall 506 and its lower terminating surface 526 provide a trimming cap 535 for trimming blade 504 and its cutting edge 536 and define the exposure for trimming blade 504. Referring to FIGS. 13 and 20, two skin protection projections 537 spaced part way in from the two ends extend into the space behind a tangent line from trimming cutting edge 536 to trimming guard 528 to limit the amount that the user's skin can bulge into the space between the trimming cutting edge 536 and the trimming guard 528.

Figure 14:
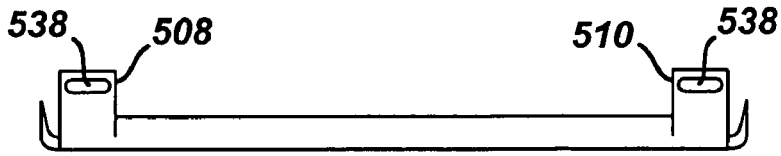
FIG. 14 is a plan view of a trimming assembly of the FIG. 13 blade unit.
Figure 15:
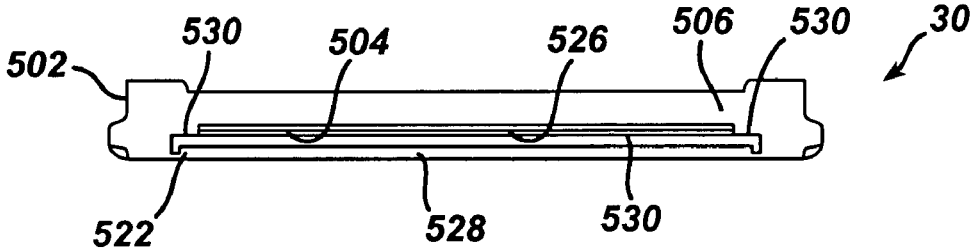
FIG. 15 is a rear elevation of the FIG. 14 trimming assembly.
Figure 16:
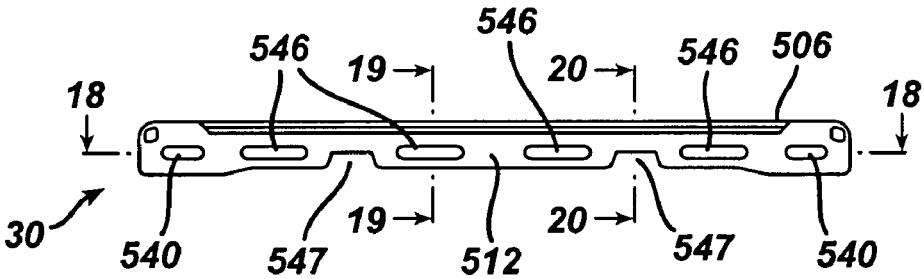
FIG. 16 is a bottom view of the FIG. 14 trimming assembly.
Figure 17:
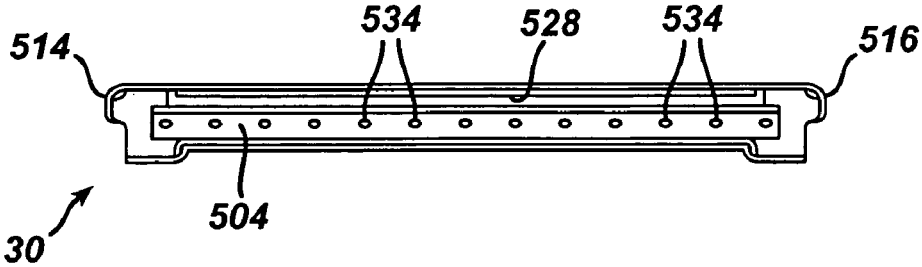
FIG. 17 is a front elevation of the FIG. 14 trimming assembly.
Figure 18:
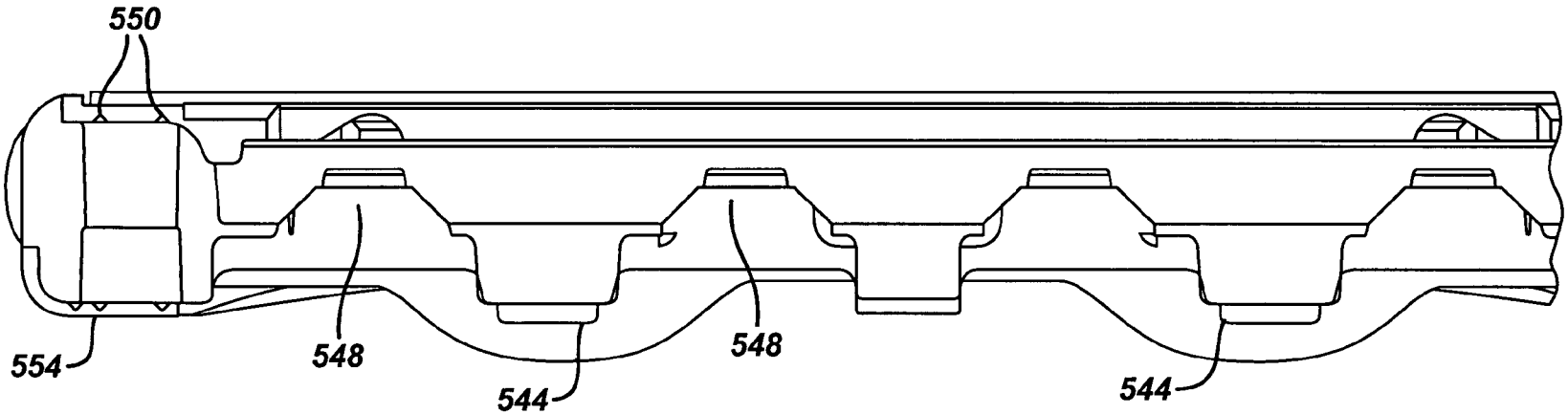
FIG. 18 is a vertical sectional view, taken at 18—18 of FIG. 16, of the housing of the FIG. 3 blade unit.
Figure 19:
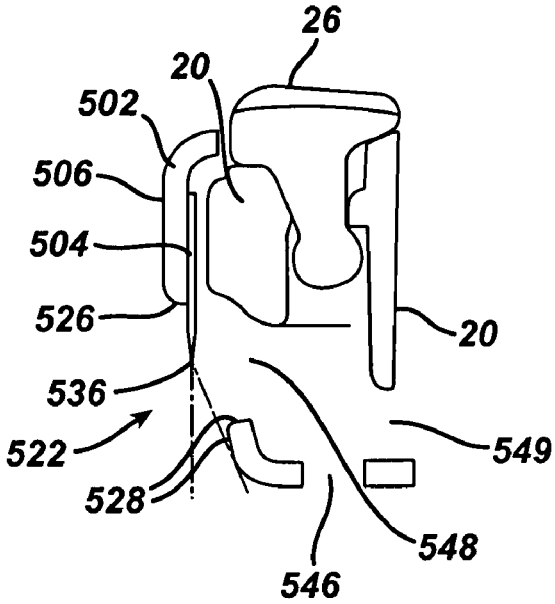
FIG. 19 is a vertical sectional view, taken at 19—19 of FIG. 16, of a portion of the FIG. 3 blade unit.

Referring to FIGS. 14 and 16, upper side tabs 508 and 510 have upper slots 538 and lower wall 512 has aligned slots 540 for receiving clips 32 used to secure trimming blade assembly 30 to housing 20. Referring to FIGS. 13 and 16, lower wall 512 also has recesses 542 for mating with projections 544 on housing 20 to facilitate aligning and retaining assembly 30 in proper position on housing 20.

Referring to FIGS. 13, 16, 18, 19, 21, 22, lower wall also has four debris removal slots 546 that are aligned with four recessed debris removal passages 548 in housing 20 to permit removal of shaving debris from the region behind and below cutting edge 536 during shaving.

In manufacture, blade carrier 506 is cut and formed from sheet metal. Trimming blade 504 is then placed against interior surface 532 with cutting edge 536 aligned with alignment surfaces 530 with an automated placement member, and then secured to interior surface 532 by spot welds 534, with trimming cutting edge 536 in precise position with respect to trimming guard 528 and trimming cap 534. Trimming assembly 30 is then placed on the back of housing 20 by sliding it forward over the rear of housing 20 with recesses 542 on lower wall 512 aligned with projections 544 on housing 20. At the same time, upper crush bumps 552 and lower crush bumps 554 on housing 20 (FIG. 18) are deformed by compression applied between upper tabs 508, 510 and lower wall 512 when assembly 30 is moved forward onto the back of housing 20. Assembly 30 is then secured to housing 20 by clips 32, which pass through upper slots 538 and lower slots 540 on blade carrier 506 and aligned slots 40, 42 through housing 20 (FIG. 4).

Because clips 32 pass through slots 538, clips 32 are in electrical contact with blade carrier 506. The clips are therefore also in electrical contact with the trimming blade 504, since the clips, blade carrier and trimming blade are all formed of metal (typically, the trimming blade and blade carrier are formed of stainless steel and the clips are formed of aluminum or an aluminum alloy). The clips 32 are also in electrical contact with each of the blades 28. The clips thus form an anode-cathode cell with the blades and trimming blade, in which the clips function as a sacrificial anode. As a result, if the shaving razor is exposed to corrosive conditions, the clips will corrode and the shaving blades and trimming blade will function as a cathode that is protected from corrosion. This sacrificial function of the clips is advantageous because corrosion of the cutting edges of the blades could pose a safety hazard to the user, while corrosion of the clips will be aesthetically unattractive and will most likely prompt the user to discard the cartridge before further damage can take place.

Guard

Referring back to FIG. 3, guard 22 includes a flexible elastomeric member 100 that extends to and over side surfaces 34. The elastomeric member 100 forms a projection 101 that is capable of mating with a dispenser (not shown) to secure the cartridge therein (e.g., for storage and/or shipping). Details of the projection 101 and dispenser can be found in pending U.S. application Ser. No. 10/798,140, entitled "Dispensers for Razor Blade Cartridges" and filed on the same date as this application, the entire contents of which are incorporated herein by reference. The elastomeric member 100 includes a plurality of fins 114, discussed in detail below, that tend to stimulate and stretch the skin in front of the blades 28, lifting and properly positioning the user's hairs for shaving.

Figure 23:
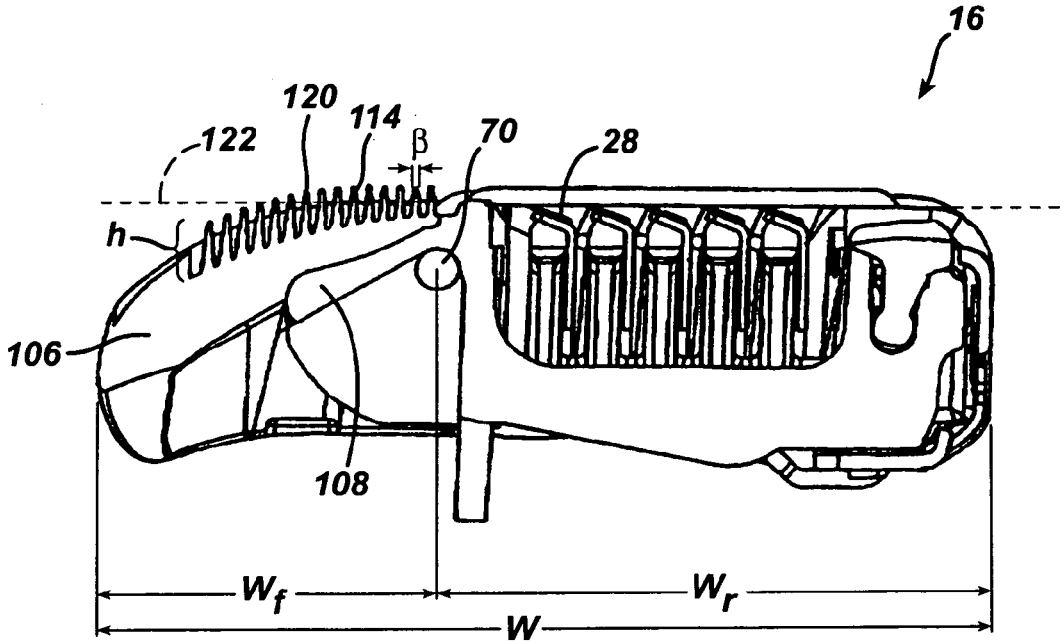
FIG. 23 is a sectional view of the blade unit of FIG. 3.
Figure 24:
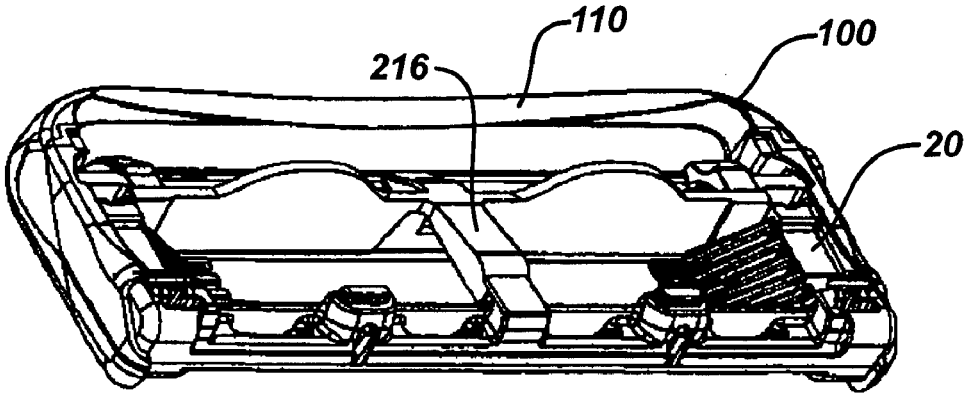
FIG. 24 is a rear perspective view of the housing including elastomeric member of FIG. 4.
Figure 25:
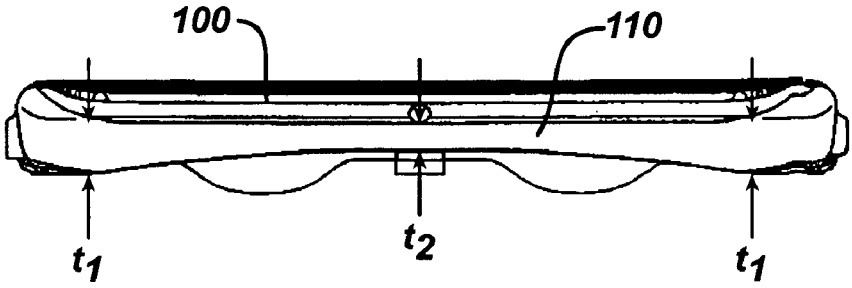
FIG. 25 is an end view of the housing including elastomeric member of FIG. 24.

The elastomeric member 100 is supported along a rear portion 102 and side portions 104 by housing 20. Referring now to FIG. 23, a front or leading portion 106 of the elastomeric member 100 extends beyond a leading portion 108 of the housing 20 and is substantially unsupported by the housing 20 along its length. The leading portion 106 of the elastomeric member is relatively flexible and can deflect upon contact with a user's skin. In some cases, the leading portion 106 is of sufficient flexibility to conform to a contour of a user's skin during use. This conformity to the user's skin will tend to increase the surface area of the elastomeric member that contacts the user's skin, enhancing skin stretch, and will also tend to more uniformly distribute the force applied by the user during shaving. Deflection of the leading portion, as it contacts the skin, also tends to cause the fins 114 to deflect towards each other, increasing the frictional force between the fin tips and the skin and thereby increasing skin stretch. To further improve flexibility of the elastomeric member 100, a thickness of the elastomeric member 100 varies along its length. As can be seen by FIGS. 24 and 25, a leading edge 110 of the leading portion 106 of the elastomeric member 100 has a first thickness $t_1$ adjacent the side surfaces 34 of the housing, and tapers to a second, lesser thickness $t_2$ adjacent a center region of the elastomeric member 100.

Referring again to FIG. 3 and also to FIG. 3D, the elastomeric member 100 includes a group 112 of resilient fins 114, positioned within a frame 115. Frame 115 provides a continuous elastomeric surface around the periphery of the fins, which may improve tracking of the cartridge during shaving, and may enhance the skin stretch and tactile properties provided by the elastomeric member. Referring also to FIG. 3A, a groove 116 is provided between a recessed wall 118 of the frame 115 and ends 120 of the fins 114. This groove 116 allows the fins to flex, for example to close together when the leading portion 106 is deflected, rather than being fixed at their ends as would be the case if the fins were joined to the frame 115 at their ends. However, if desired the fins can be joined to the frame, or the frame 115 can be omitted and the fins can extend the full length of the guard.

In the embodiment shown, group 112 includes 15 fins. Generally, the elastomeric member may include fewer or more fins (e.g., between about 10 and 20 fins). For a given pitch and fin geometry, more fins will generally give greater skin stretch, for a closer shave; however, above a certain number of fins skin stretch tends not to increase (or increased skin stretch is not necessary) and the elastomeric member may become overly wide, making it difficult for the user to shave in tight areas.

Referring back to FIG. 23, tips 120 of the elastomeric fins 114 increase in elevation from the fin furthest from the blades 28 to the fin closest to the blades 28 along a curve. Some of the tips 120 lie below a plane 122 that passes through the cutting edges 48 of the blades 28 and some of the tips 120 are above the plane 122. The increasing elevation of fins 114 tends to gradually increase skin contact. The increasing elevation also causes the tips to conform to the skin during shaving. Fins 114 have a tip to base height "h" of 0.4 to 0.9 mm and a narrow profile, i.e., the fins define an included angle β of less than about 14 degrees (preferably between 8 and about 14 degrees, such as about 11 degrees). The fins 114 are spaced at a pitch of between about 0.014 and 0.57 mm center-to-center, e.g., 0.284 mm, and are between about 0.1 and 0.4 mm, e.g., 0.217 mm, thick at their bases. The distance from the front of one fin 114*a* to the back of the last fin 114*b* at the base is about 4 mm. Alternatively, this distance can be between about 2.5 and 6 mm. The narrow, e.g., 8 to 14 degree fin profile β improves fin flexibility, which helps stretch the skin, thereby setting up the hairs for improved cutting.

Figure 26:
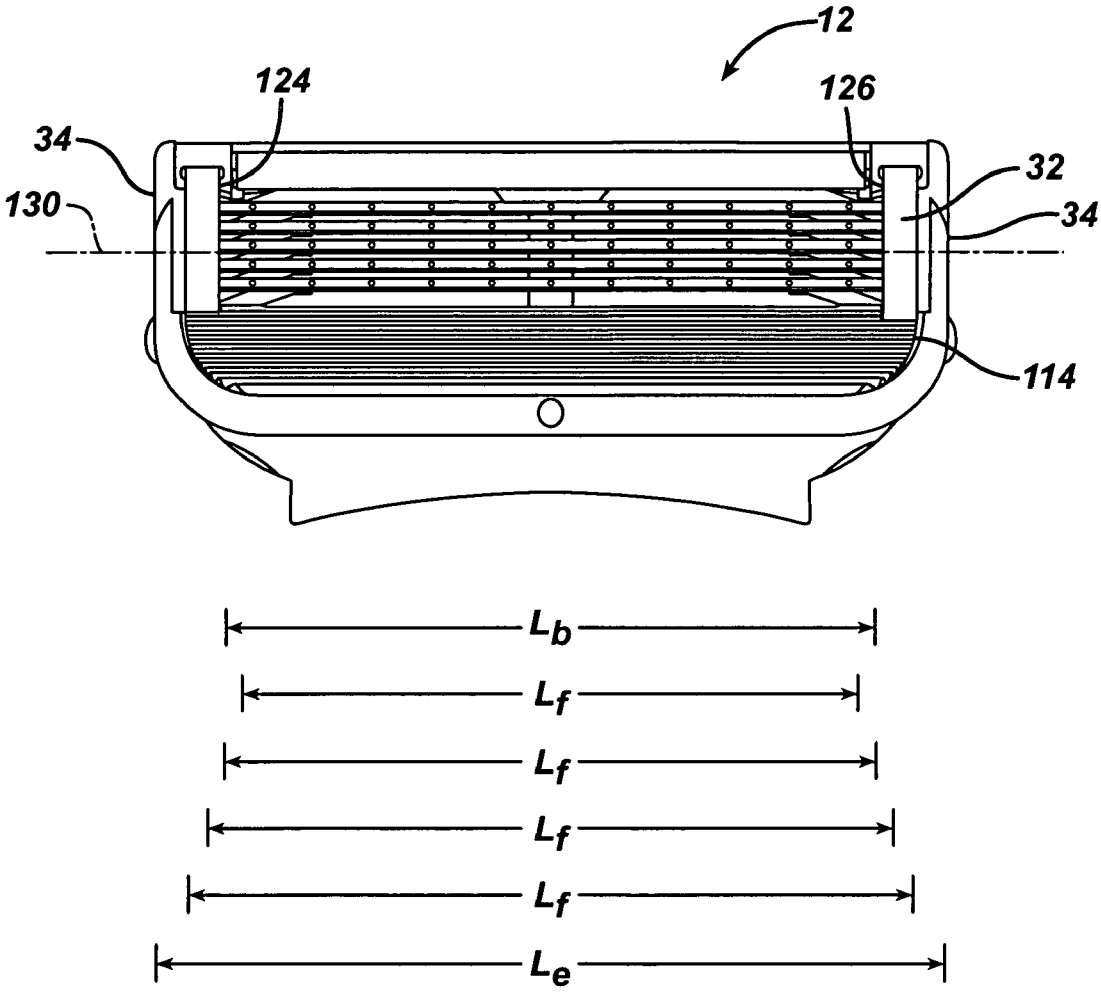
FIG. 26 is a front view of the cartridge of FIG. 3.

Referring now to FIG. 26, the elastomeric member 100, by extending to and over side surfaces 34, has a length $L_e$, measured between side surfaces 34, (preferably between about 34 mm to about 47 mm, such as about 42.5 mm) that is longer than a blade length $L_b$ (preferably between about 33 mm to about 46 mm, such as about 34.4 mm) of each of the blades 28, where $L_b$ is measured between inside clip edges 124 and 126. The length of the elastomeric member provides good skin stretch and enhances the tactile properties of the razor. $L_e$ can be, for example, between about zero and 36 percent longer than $L_b$, such as 23.5 percent. The fins 114 have a fin length $L_f$ measured along a fin axis 128 substantially parallel with a blade axis 130. As can be seen, the fin lengths $L_f$ increase from the fin furthest from the blades 28 to the fin closest to the blades 28. $L_f$ of at least some (or all) of the fins 120 is greater than $L_b$. This increasing length arrangement, along with frame 116, can improve maneuverability along the contour of the skin.

The material for forming the elastomeric member 100 can be selected as desired. Preferably, the elastomeric member is formed of an elastomeric material, such as block copolymers (or other suitable materials), e.g., having a durometer between 28 and 60 Shore A. Preferably, the fins 114 are also made of a relatively soft material, e.g., having a Shore A hardness of between about 28 and 60 (for example, between about 40 and 50, such as between about 40 and 45 Shore A). As values are increased above this range, performance may tend to deteriorate, and as values are decreased below this range there may be production problems. As shown, the fins and elastomeric member are integrally formed of the same material. In other cases, the fins and elastomeric member are formed of differing materials. The method of securing the elastomeric member 100 to the housing 20 can also be selected as desired. Suitable methods include, as examples, adhesives, welding and molding (e.g., over-molding or two-shot molding) the elastomeric member onto the housing 20.

Pivoting Structure/Cartridge Balance

Referring to FIGS. 1 and 2, blade unit 16 is pivotally mounted on connecting member 18. Connecting member 18 is constructed to receive a handle connecting structure 11 on handle 14 in releasable engagement, as will be discussed in detail below in the "Cartridge/Handle Connection" section. The blade unit 16 can pivot about a pivot axis 70 relative to the handle 14 and connecting member 18 due to cooperating pivot structures provided by the housing 20 and connecting member 18.

Figure 36:
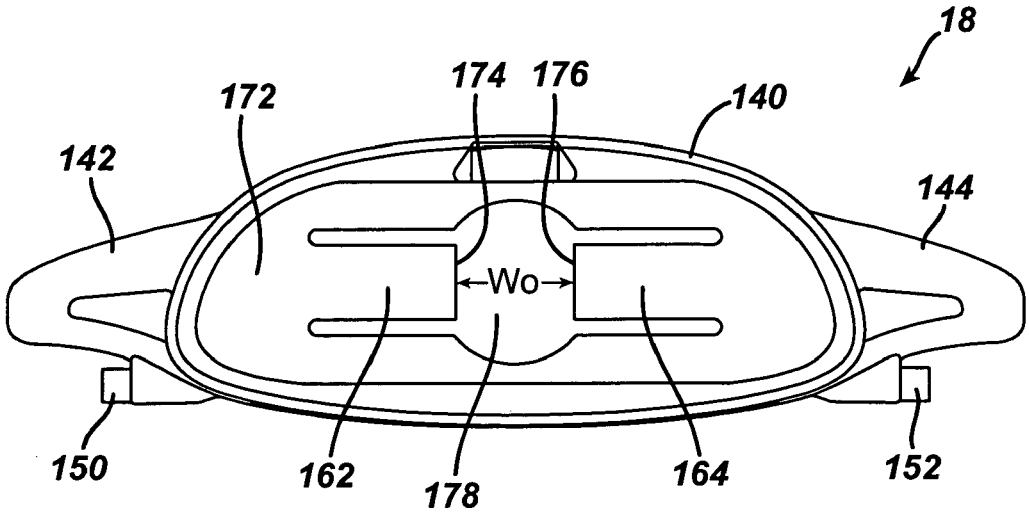
FIGS. 36–38 are rear, front and top views, respectively, of a connecting member.
Figure 37:
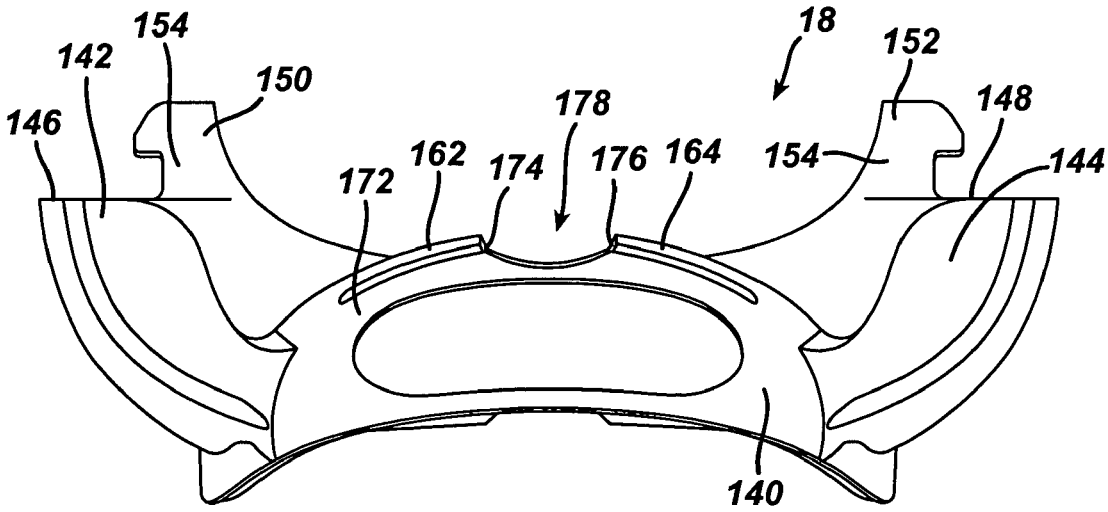
Figure 37A:
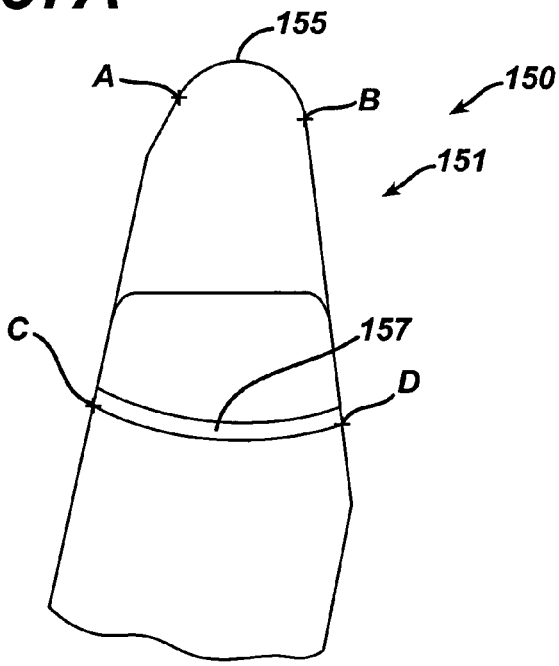
FIG. 37A is a detail view of a finger of the connecting member of FIGS. 36–38.
Figure 38:
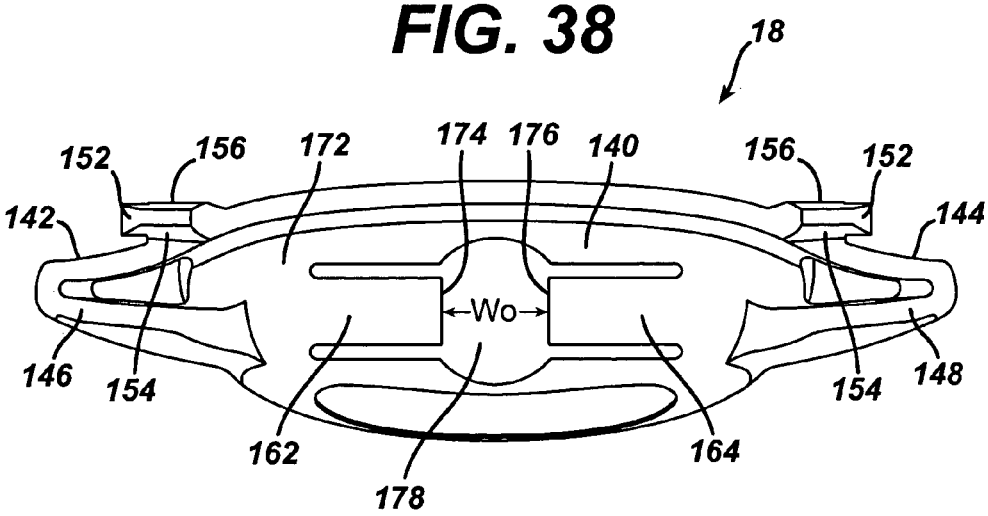

Referring to FIGS. 36–38, the connecting member 18 has a body 140 and a pair of arms 142 and 144 extending outwardly from the body 140. Extending from U-shaped ends 146 and 148 of the arms 142 and 144 are fingers 150 and 152. The fingers 150 and 152 pivotally connect to the blade unit 16, e.g., by insertion into openings in the back of the housing 20 (FIG. 3B), and allow the blade unit 16 to pivot about axis 70 (FIG. 23) relative to the connecting member 18. Referring to the detail view of FIG. 37A showing a side view of finger 150, the fingers 150 and 152 each include projecting distal ends 151 and 153, which define the end points A, B, C, D of two coaxial circular arcs 155 and 157 that form bearing surfaces of the connecting member 18 and housing 20 connection. These arc surfaces fit (with clearance) within mating arcuate receptors (not shown) on the cartridge housing 20 and permit pivoting. The smaller arc 155 is under load when the blade unit 16 is pivoted. The larger arc 157 is under load when the blades 28 are cutting during shaving.

Figure 40:
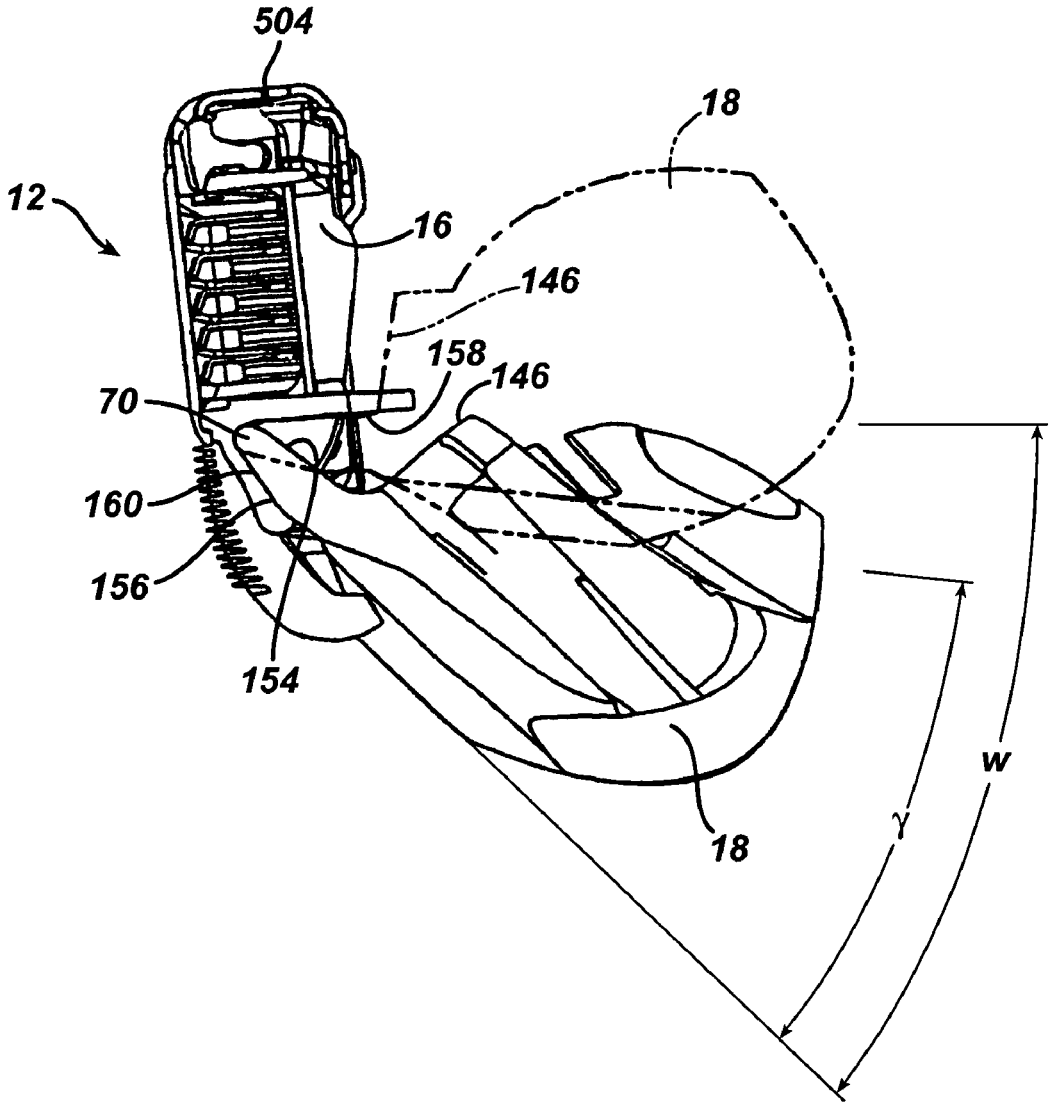
FIG. 40 is a section view of the cartridge of FIG. 3.

Referring also to FIG. 40, each finger includes stop surfaces 154 and 156 (FIG. 38). The stop surfaces 154 and 156 can engage cooperating stop surfaces 158 and 160 (FIG. 40) of the blade unit 16 to limit the blade unit's rotation. As shown in FIG. 40, the stop surfaces 154, 156, 158, 160 inhibit normal rotation of the blade unit 16 beyond an angle $\gamma$ of about 41 degrees, with the spring-biased, rest position being zero degrees. Surfaces 156 and 160 also provide a stop to inhibit rotation during a trimming operation using trimming blade 504.

Referring to FIG. 37, the end surfaces 146 and 148 serve as load-bearing structures in the event of over rotation of the blade unit 16 relative to the connecting member 18. Such over rotation may occur, e.g., if the razor is dropped by the user. As shown in FIG. 40, the housing 20 can contact the end surfaces 146 and 148 in the event the blade unit is rotated an angle $\omega$ which is greater than $\gamma$ (e.g., greater than 41 degrees, between about 42 degrees and 45 degrees, such as about 43 degrees). By providing these load-bearing structures, load can be transmitted to end surfaces 146, 148 and arms 142, 144, thus relieving stress on the fingers 150, 152 (e.g., to prevent finger breakage).

Referring again to FIG. 1, the blade unit 16 is biased toward an upright, rest position (shown by FIG. 1) by a spring-biased plunger 134. A rounded distal end 139 of the plunger 134 contacts the cartridge housing at a cam surface 216 (FIG. 47) at a location spaced from the pivot axis 70 to impart a biasing force to the housing 20. Locating the plunger/housing contact point spaced from the pivot axis 70 provides leverage so that the spring-biased plunger can return the blade unit 16 to its upright, rest position upon load removal. This leverage also enables the blade unit 16 to pivot freely between its upright and fully loaded positions in response to a changing load applied by the user.

Figure 47A:
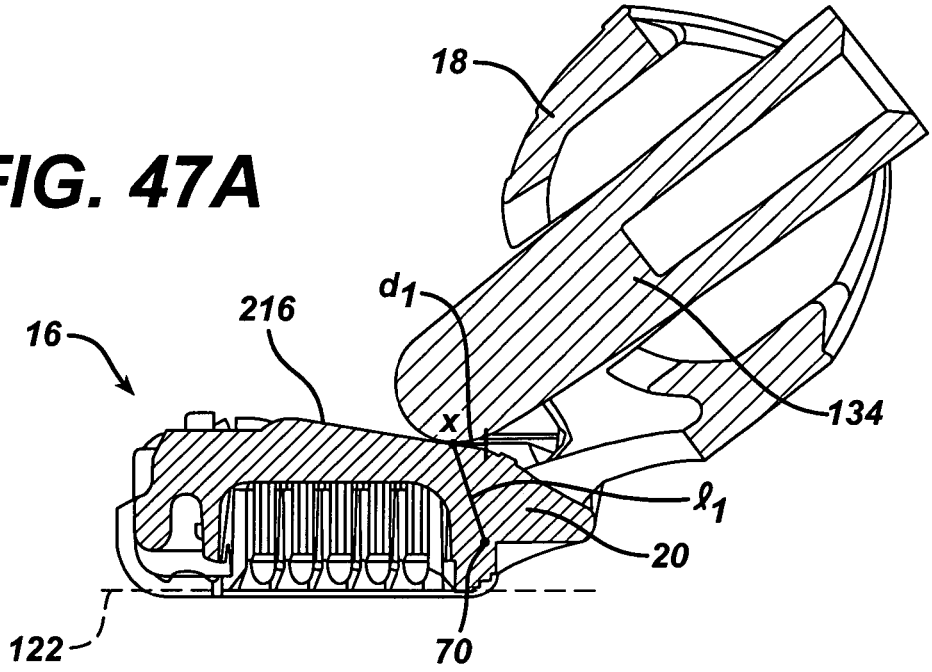
FIG. 47A is a section view of the cartridge of FIG. 3 in the rest position and plunger of FIGS. 34 and 35 and FIG. 47B is a section view of the cartridge of FIG. 3 in the fully rotated position and the plunger of FIGS. 34 and 35.
Figure 47B:
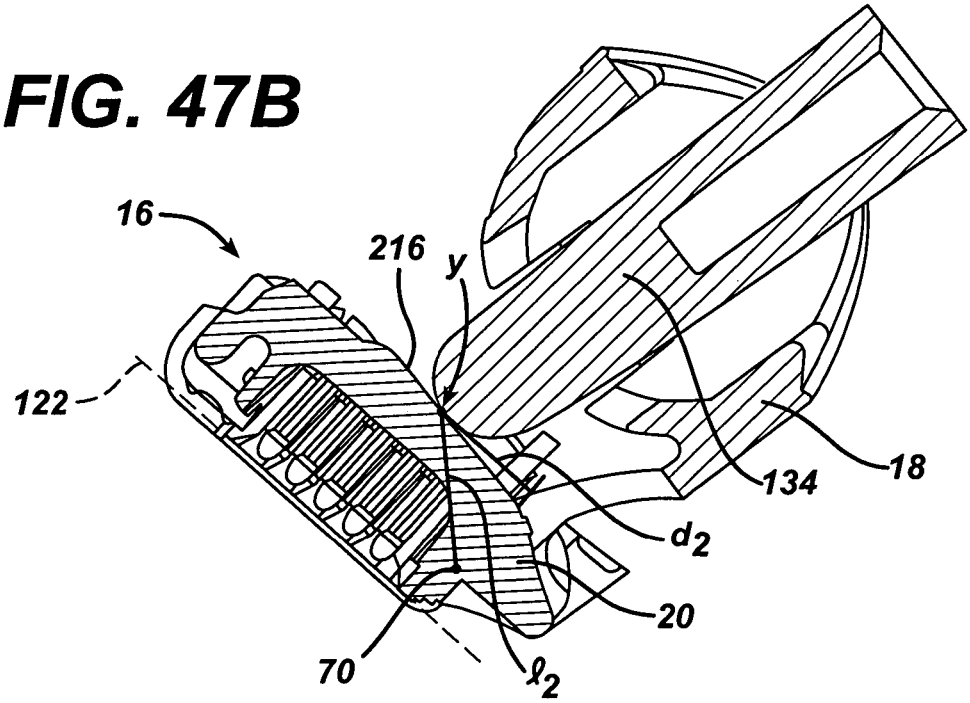

Referring now to FIGS. 47A and 47B, as the blade unit 16 rotates relative to the handle, the contact point between the plunger 134 and the cam surface 216 changes. The horizontal distance $d_1$ and the direct distance $l_1$ are each at a minimum at point X when the blade unit 16 is at the spring-biased, rest position, with $d_1$ measured along a horizontal line that is perpendicular to the pivot axis 70 and parallel to plane 122. The horizontal distance $d_2$, also measured along a horizontal line that is perpendicular to the pivot axis 70 and parallel to plane 122, and direct distance $l_2$ are each at a maximum at contact point Y when the blade unit 16 is at the fully rotated position. In the embodiment shown, $d_1$ is about 0.9 mm, $l_1$ is about 3 mm, $d_2$ is about 3.5 mm and $l_2$ is about 5 mm. Alternatively, $d_1$ can be between about 0.8 and 1.0 mm, $l_1$ can be between about 2.5 and 3.5 mm, $d_2$ can be between about 3 and 4 mm and $l_2$ can be between about 4.5 and 5.5 mm.

As the blade unit 16 is rotated from its rest position, the torque about the pivot axis due to the force applied by plunger 134 increases due, at least in part, to the increasing horizontal distance between the contact point and the pivot axis 70 and the rotation of the plunger 134 to a more perpendicular orientation to the cam surface 216. In some embodiments, the minimum torque applied by the spring-biased plunger, e.g., in the rest position, is at least about 1.5 N-mm, such as about 2 N-mm. In some cases, the maximum torque applied by the plunger, e.g., in the fully rotated position, is about 6 N-mm or less, such as about 3.5 N-mm.

Referring now to FIG. 23, the connecting member 18 and housing 20 are connected such that the pivot axis 70 is located below plane 122 (e.g., at a location within the housing 20) and in front of the blades 28. Positioning the pivot axis 70 in front of the blades 28 is sometimes referred to as a "front pivoting" arrangement.

The position of the pivot axis 70 along the width W of the blade unit 16 determines how the cartridge will pivot about the pivot axis, and how pressure applied by the user during shaving will be transmitted to the user's skin and distributed over the surface area of the razor cartridge. For example, if the pivot axis is positioned behind the blades and relatively near to the front edge of the housing, so that the pivot axis is spaced significantly from the center of the width of the housing, the blade unit may tend to exhibit "rock back" when the user applies pressure to the skin through the handle. "Rock back" refers to the tendency of the wider, blade-carrying portion of the blade unit to rock away from the skin as more pressure is applied by the user. Positioning the pivot point in this manner generally results in a safe shave, but may tend to make it more difficult for the user to adjust shaving closeness by varying the applied pressure.

In blade unit 16, the distance between the pivot axis and the front edge of the blade unit is sufficiently long to balance the cartridge about the pivot axis. By balancing the cartridge in this manner, rock back is minimized while still providing the safety benefits of a front pivoting arrangement. Safety is maintained because the additional pressure applied by the user will be relatively uniformly distributed between the blades and the elastomeric member rather than being transmitted primarily to the blades, as would be the case in a center pivoting arrangement (a blade unit having a pivot axis located between the blades). Preferably, the distance from the front of the blade unit to the pivot axis is sufficiently close to the distance from the rear of the blade unit to the pivot axis so that pressure applied to the skin through the blade unit 16 is relatively evenly distributed during use. Pressure distribution during shaving can be predicted by computer modeling.

Referring to FIG. 23, the projected distance $W_f$ is relatively close to the projected distance $W_r$. Preferably, $W_f$ is within 45 percent of $W_r$, such as within 35 percent. In some cases, $W_r$ is substantially equal to $W_f$. Preferably, $W_f$ is at least about 3.5 mm, more preferably between 5.5 and 6.5 mm, such as about 6 mm. $W_r$ is generally less than about 11 mm (e.g., between about 11 mm and 9.5 mm, such as about 10 mm).

A measure of cartridge balance is the ratio of the projected distance $W_r$ between the rear of the blade unit 16 and the pivot axis 70 to the projected distance W between the front and rear of the blade unit 16, each projected distance being measured along a line parallel to a housing axis 217 (FIG. 3) that is perpendicular to the pivot axis 70. The ratio may also be expressed as a percentage termed "percent front weight".

Figure 27:
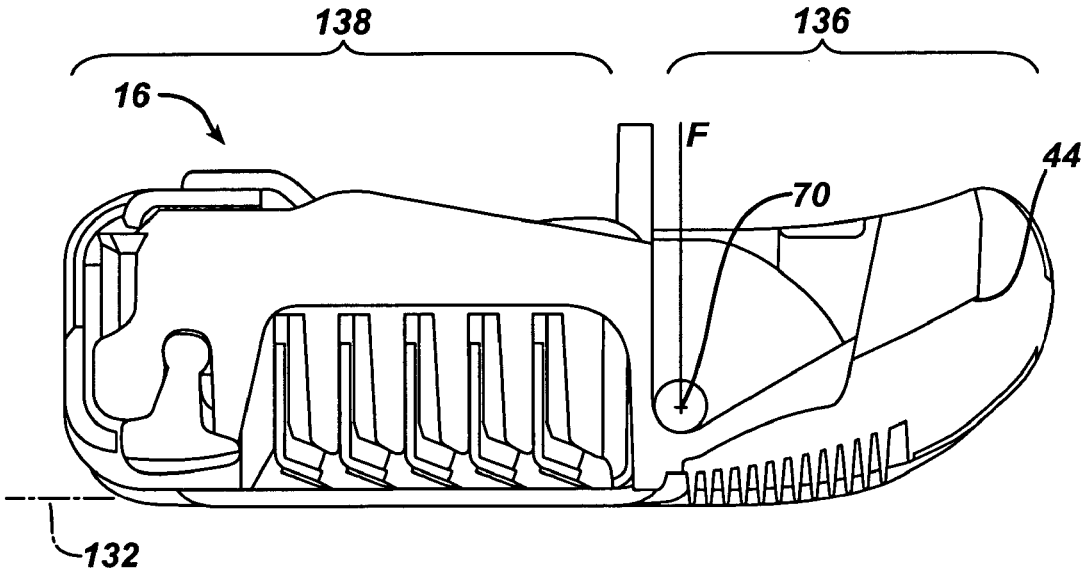
FIG. 27 is a section view of the blade unit of FIG. 3 weighted against skin.

Referring now to FIG. 27, the blade unit 16 is shown weighted against skin 132. Blade unit 16 is weighted by application of a normal force F perpendicular to the pivot axis 70 (i.e., applied through handle 14 by a user and neglecting other forces, such as that applied by spring-biased plunger 134 shown by FIG. 39). Preferably, a weight percent (or percent front weight) carried along $W_f$ is at most about 70 percent (e.g., between about 50 percent and about 70 percent, such as about 63 percent) of a total weight carried by the blade unit 16.

By balancing the cartridge, the weight carried by the front portion 136 over $W_f$ and rear portion 138 over $W_r$ is more evenly distributed during use, which corresponds to a more even distribution of pressure applied to the shaving surface during shaving. Also, more weight is shifted to the rear portion 138 of the cartridge 12 where the blades 28 are located during use, inhibiting rock back of the rear portion 138, which can provide a closer shave.

Cartridge/Handle Connection

As discussed above with reference to FIGS. 1 and 2, the connecting member 18 removably connects the blade unit 16 to a handle connecting structure 11 on handle 14.

Figure 41:
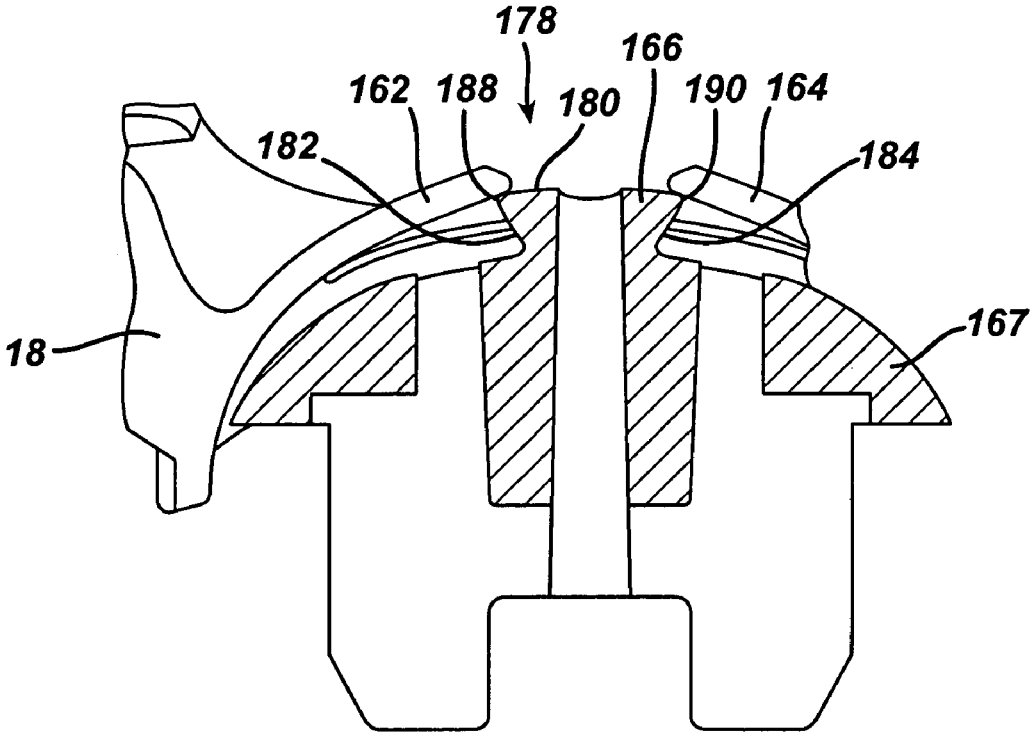
FIG. 41 is a section view of the handle of FIG. 2A connecting with the connecting member of FIGS. 36–38.

Referring to FIGS. 2, 2A and 41 (FIG. 41 omitting the plunger, button and spring for clarity), to connect the connecting member 18 and the handle 14, the user pushes the handle connecting structure 11 forward into the back end of the connecting member 18. The handle connecting structure includes a body 167 from which a projection 166 protrudes. Projection 166 is positioned to be received by an opening 178 in the connecting member 18. As the projection 166 is inserted into the opening, latches 162 and 164 on the connecting member elastically deflect to receive the distal end 180 of the projection 166. When the latches 162 and 164 clear outer edges 188 and 190 of the distal end 180 of the projection 166, the latches 162 and 164 recover toward their initial, undeflected position as they engage side surfaces 182 and 184 of the projection (FIG. 39).

Figure 41A:
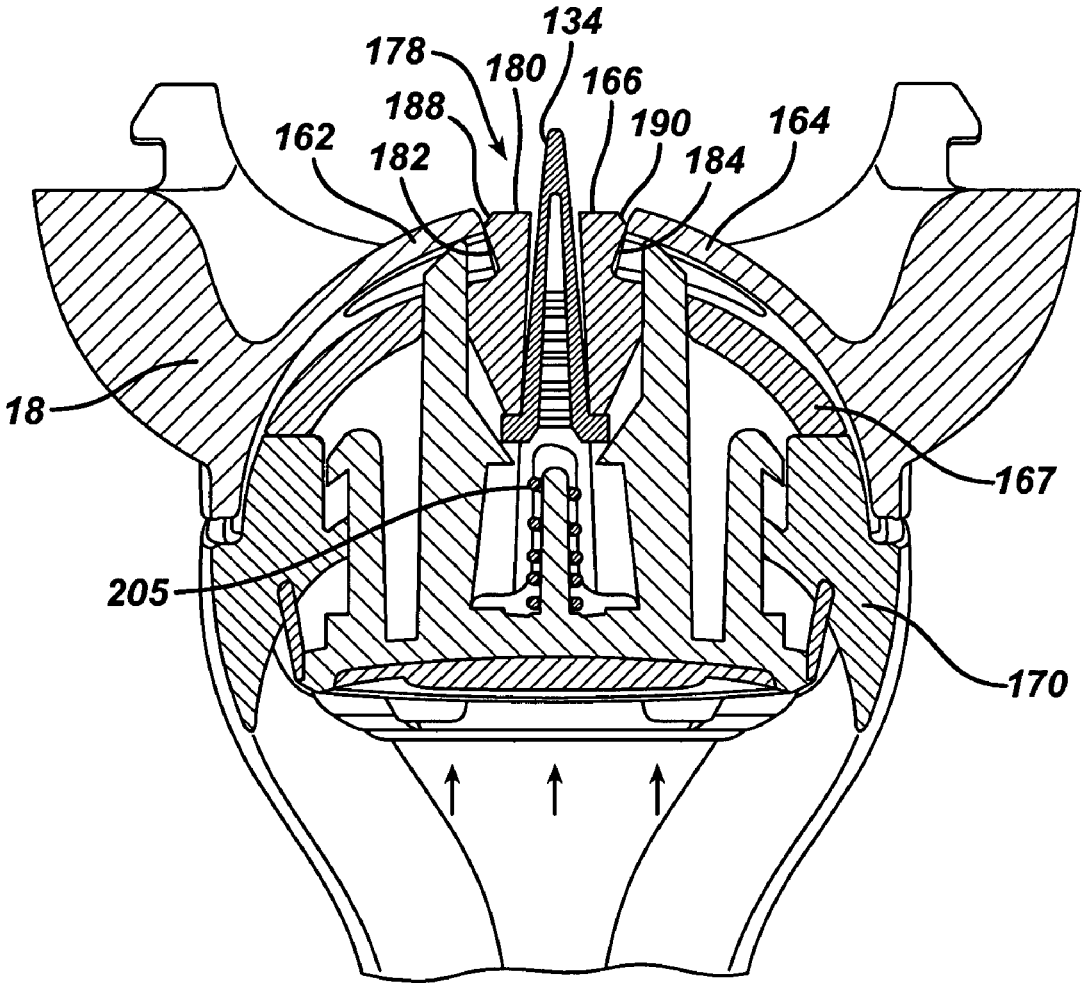
FIG. 41A is a section view of the handle of FIG. 2A through line 41—41 showing the release button being actuated to disconnect the cartridge from the handle.

Referring to FIG. 41A, to disconnect the cartridge 12 from the handle 14, the user actuates a spring-biased release button 196 by pressing the button 196 forward relative to handle casing 170. Pushing button 196 forward extends pusher arms 192 and 194 into engagement with the latches 162 and 164 of the connecting member 18. This engagement forces open the interference fit between the latches 162, 164 and the projection 166 to release the cartridge 12 from the handle 14, as will be described in greater detail below.

Figure 39:
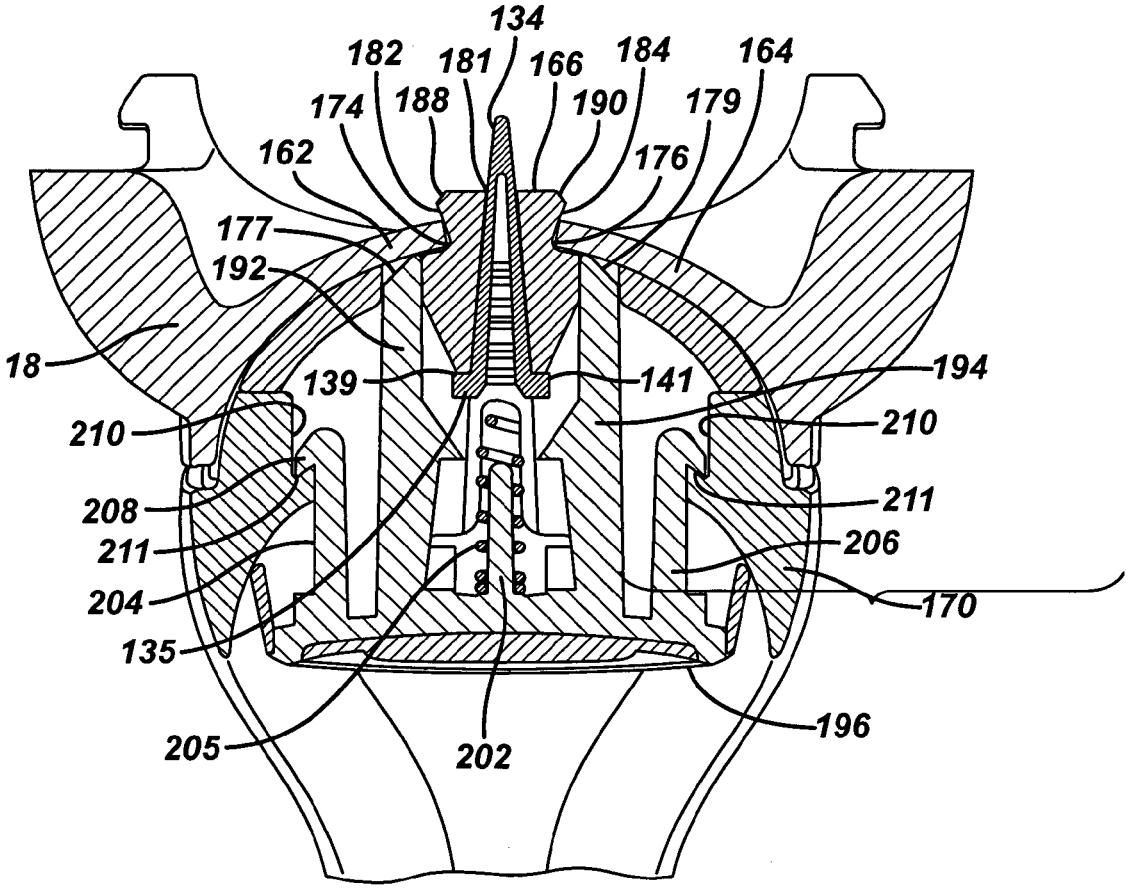
FIG. 39 is a section view of the handle through line 39 of FIG. 2A including the connecting member.

Referring now to FIG. 39, which shows the cartridge 12 and handle 14 connected, the latches 162 and 164 of the connecting member 18 have respective free distal ends 174, 176 that engage the angled side surfaces 182 and 184 of projection 166. The side surfaces 182 and 184 taper from the relatively large distal end 180 to a relatively smaller base 186, forming a projected apex angle $\alpha$ (e.g., between about 45 and 60 degrees, such as about 52 degrees). The taper of the side surfaces 182 and 184 inhibits unintended removal of the cartridge 12 from the handle 14 (e.g., by a force applied to a rear portion of the blade unit 16 during a trimming operation). The engagement of planar side surfaces 182 and 184 with the flat edges of the distal ends 174, 176 of latches 162 and 164 also inhibits rotational motion of the connecting member 18 relative to the handle connecting structure 11.

Figure 29:
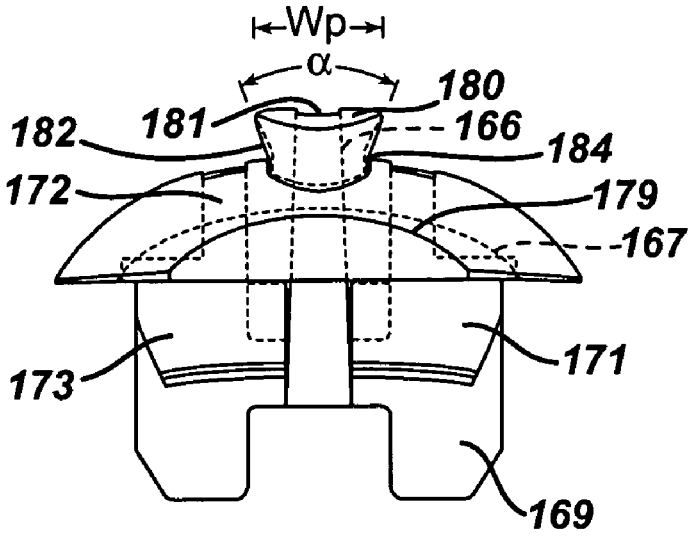
FIGS. 29 and 30 are front and side views, respectively, of a handle interconnect member.

Referring to FIGS. 36–38, the connecting member 18 includes a body 140 from which the latches 162 and 164 extend. The body 140 is contoured with an arched profile to mate with body 167, which has a correspondingly arched profile (FIG. 29). The contours of the body 140 and the body 167 are also asymmetrically shaped, when viewed from the front, to assist the user in connecting the cartridge 12 to the handle 14 in the correct orientation. For example, referring to FIG. 36, the body 140 may be generally D-shaped when seen from the front, and the body 167 may have a corresponding D-shape. These corresponding arched and asymmetrical contours also inhibit relative rotation of the connecting member 18 and handle connecting structure 11.

The latches 162 and 164 extend generally along the contour of and integrally from a wall 172 of the body 140 to opposing, free distal ends 174 and 176. Each distal end 174 and 176 forms a portion of an opening 178 extending through wall 172 to receive the projection 166. Referring also to FIG. 29, opening 178 is smaller than the distal end 180 of projection 166. Thus, the width $W_p$ of the distal end of the projection is preferably between about 4 mm and 7 mm, such as about 5.6 mm, while the width $W_o$ between the free distal ends 174 and 176 of latches 162 and 164 is preferably between about 3 mm and 6 mm, such as about 4.8 mm.

Figure 30:
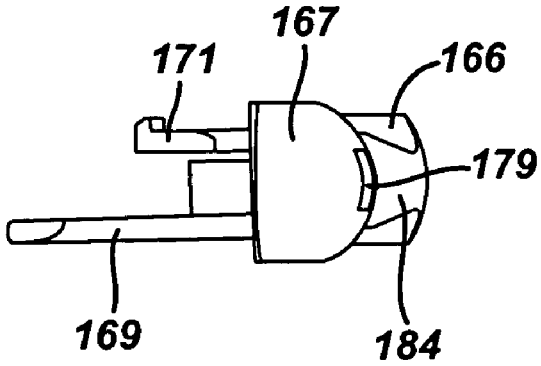
Figure 31:
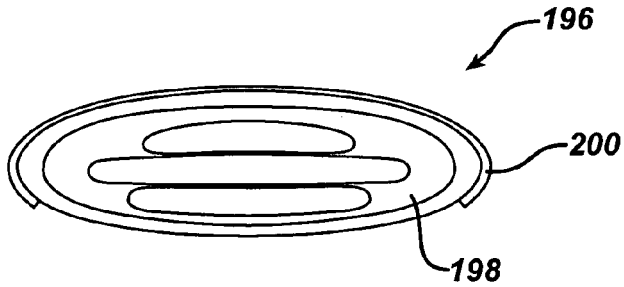
FIGS. 31–33 are top, front and side views, respectively, of a release button.
Figure 32:
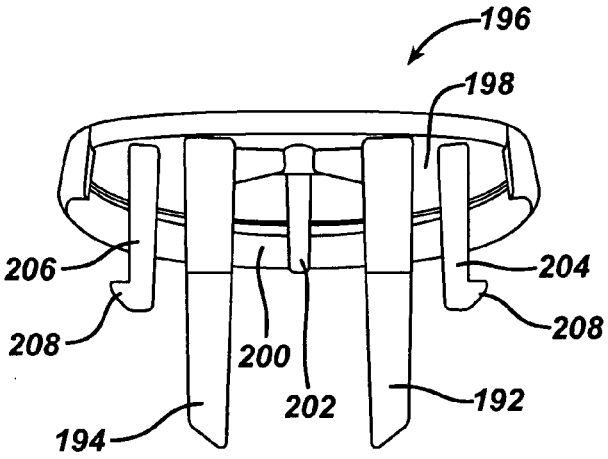
Figure 33:
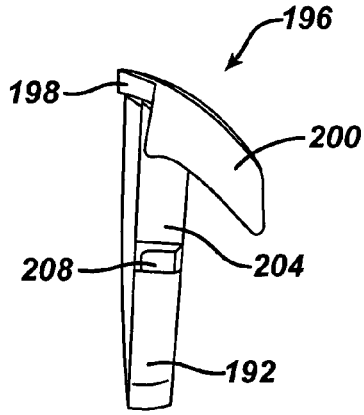

Referring now to FIGS. 29, 30 and 39, two slots 177 and 179 extend through body 167 on opposite sides of projection 166. A third slot 181 extends through the body 167 and to a distal end 180 of the projection 166. The slots 177 and 179 receive respective pusher arms 192 and 194 extending from the release button 196 and slot 181 receives plunger 134 (FIG. 39). Referring to FIGS. 29 and 30, extending from a rear portion of the body 167 are a pair of latch arms 171 and 173 that help secure the body 167 to the handle casing 170 and a guide member 169 that helps guide the release button 196 as it is actuated.

Referring now to FIGS. 31–33 and 39, the pusher arms 192 and 194 are formed as an integral part of release button 196. The release button 196 also includes latch arms 204 and 206, a cylindrical extension 202 sized to receive spring 205, and a button substrate 198 from which the pusher arms, latch arms and cylindrical extension extend. An elastomeric canopy 200 extends around the periphery of the button substrate to fill the gap between the button substrate and the surrounding handle casing that is required in order to allow sufficient clearance for the button to move relative to the handle. The latch arms 204 and 206 each include a catch 208 that slidably engages a respective track 210 (FIG. 28) formed in the handle casing 170, allowing the button to slide backward and forward. The catches 208 also inhibit removal of the release button 196 from the handle casing 170 by engaging a lip 211 (FIG. 39) formed by an end of a respective track 210. As will be described below, the elastomeric canopy 200 extends from the button substrate 198 to the handle casing 170 and conceals the extension 202, spring 205, body 167 and the base of the plunger 134 from the user.

Figure 34:
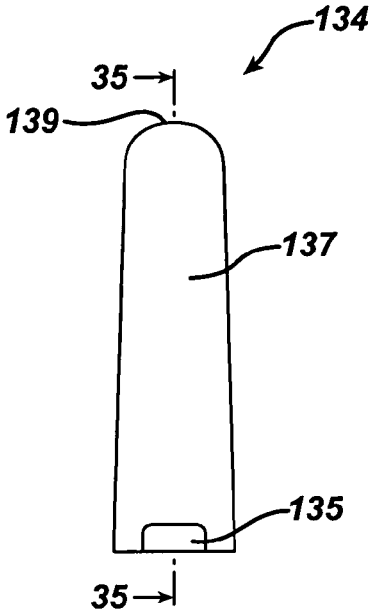
FIGS. 34 and 35 are front and section views of a plunger.
Figure 35:
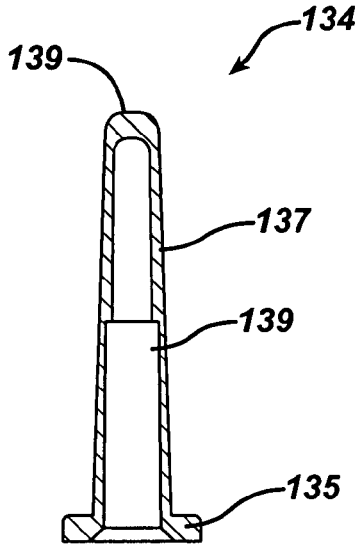

The button 196 and the plunger 134 (the function of which is described above in the "Pivoting Structure" section) are biased in opposing directions by spring 205. Referring to FIGS. 34 and 35, the plunger 134 includes a cavity 139 formed within a plunger body 137 and capable of receiving the spring 205, and base members 135 that seat against inner surfaces 139, 141 within the body 167 (FIG. 39) when the plunger 134 is in an extended position. Spring 205 biases the button away from the cartridge, returning the button to its normal position after it is released by the user.

Referring again to FIG. 41A, when the user pushes the button 196 forward the pusher arms 192 and 194 are capable of applying sufficient force to the latches 162 and 164 to disengage the interference fit between the connecting member 18 and the projection 166. Once the pusher arms 192 and 194 force ends 174 and 176 of the latches 162 and 164 beyond edges 188 and 190 of the projection 166, the latches 162, 164 spring back toward their undeflected positions, thus projecting the cartridge 12 away from the handle 14.

Figure 42:
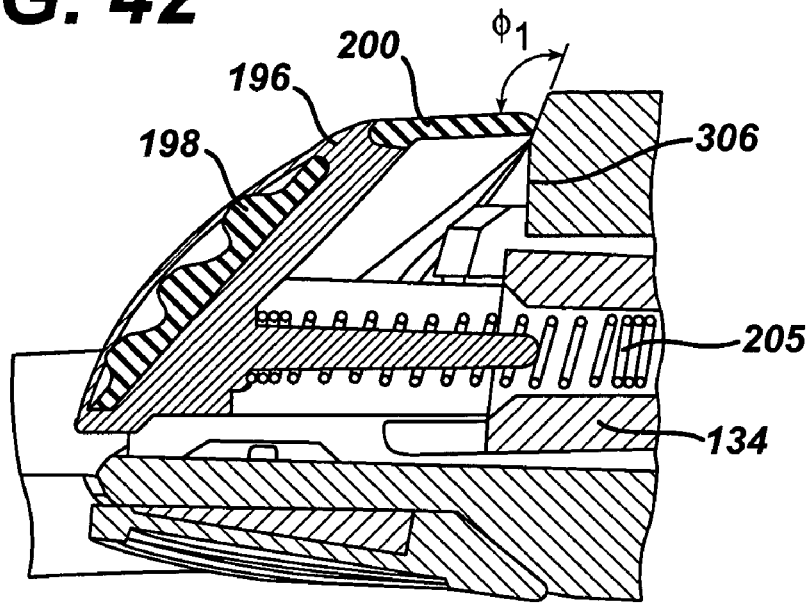
FIGS. 42 and 43 are section views of the handle of FIG. 2A through line 42—42 showing, respectively, the release button of FIGS. 31–33 in its rest and actuated positions.
Figure 43:
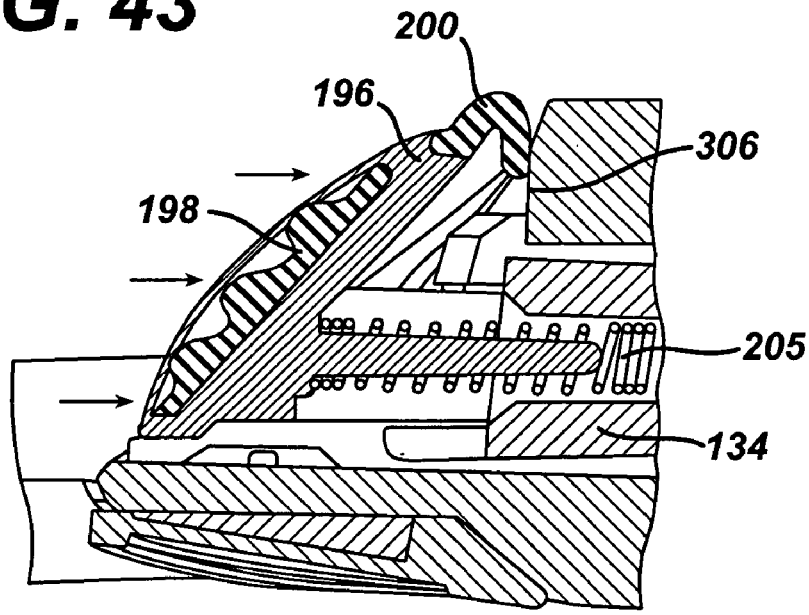

Referring now to FIG. 42, release button 196 is shown in its rest position. The canopy 200 extends from the button substrate 198 to surface 306 to conceal the spring 205, pusher arms 192 and 194 and the base of the plunger 134 from the view of the user. Referring now to FIG. 43, as the release button 196 is actuated, the pusher arms 192 and 194 are pushed forward and the canopy 200 buckles between the button substrate 198 and the surface 306. When the button 196 is released, the spring 205 forces the button 196 back to its initial position and the canopy 200 recovers to its unbuckled state.

Figure 44:
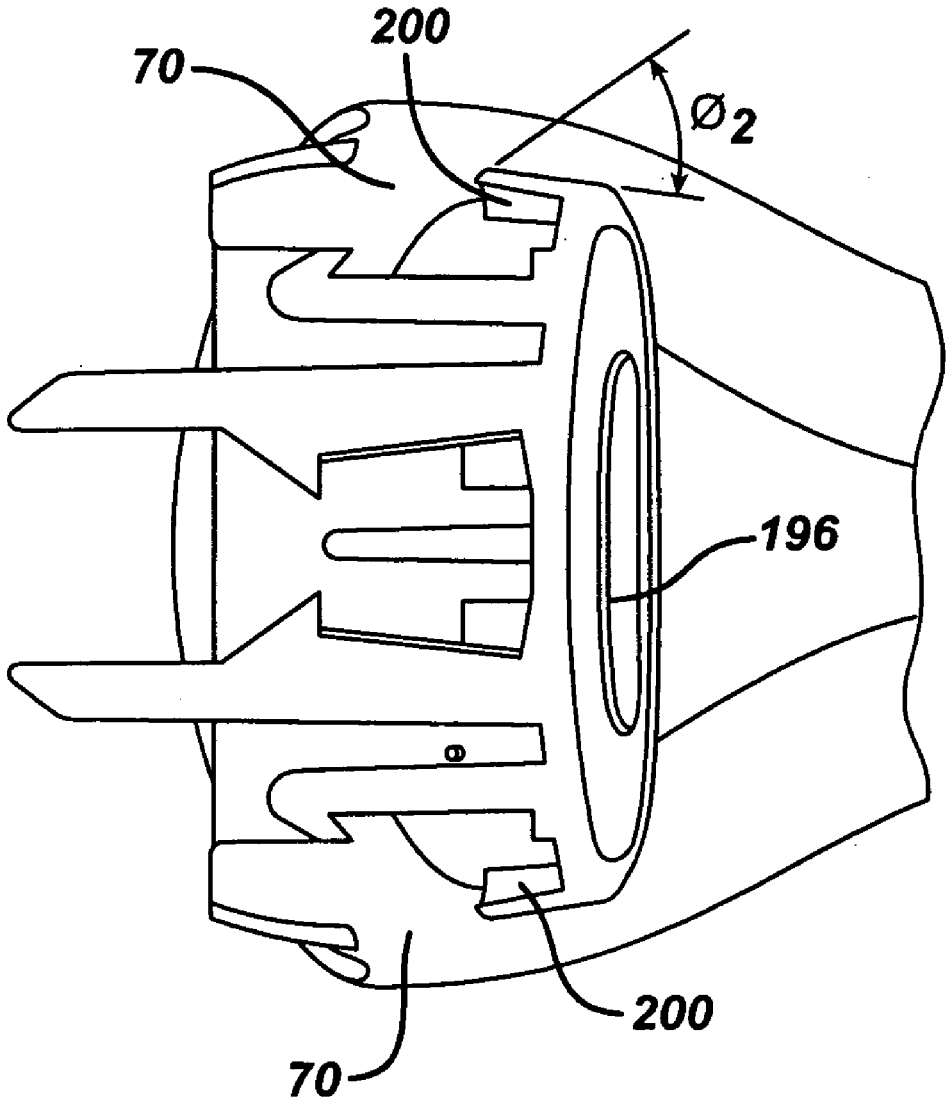
FIG. 44 is a section view of the handle casing including release button.

Referring to FIGS. 42 and 44, preferably, the contact angle $\phi_1$ between the handle casing 170 and the canopy 200 at most about 110 degrees, when the button is at its rest position and the canopy is fully recovered. This facilitates controlled buckling of the canopy 200 as the button 136 is actuated. Contact angles greater than 110 degrees may cause the canopy 200 to slide over the surface of the handle casing 170 rather than buckle. Due to the shape of the handle casing 170, the angle $\phi$ varies along the periphery of the canopy 200 from a maximum contact angle $\phi_1$ (e.g., about 110 degrees) at the center of the canopy 200 (FIG. 42) to a minimum contact angle $\phi_2$ (e.g., about 50 degrees) at each side of the canopy (FIG. 44).

Materials for forming the canopy can be selected as desired. Suitable materials include, for example, elastomers such as thermoplastic elastomers, silicone and latex. The thickness of the canopy can be between about 0.3 mm and 0.6 mm, such as about 0.5 mm.

Figure 28:
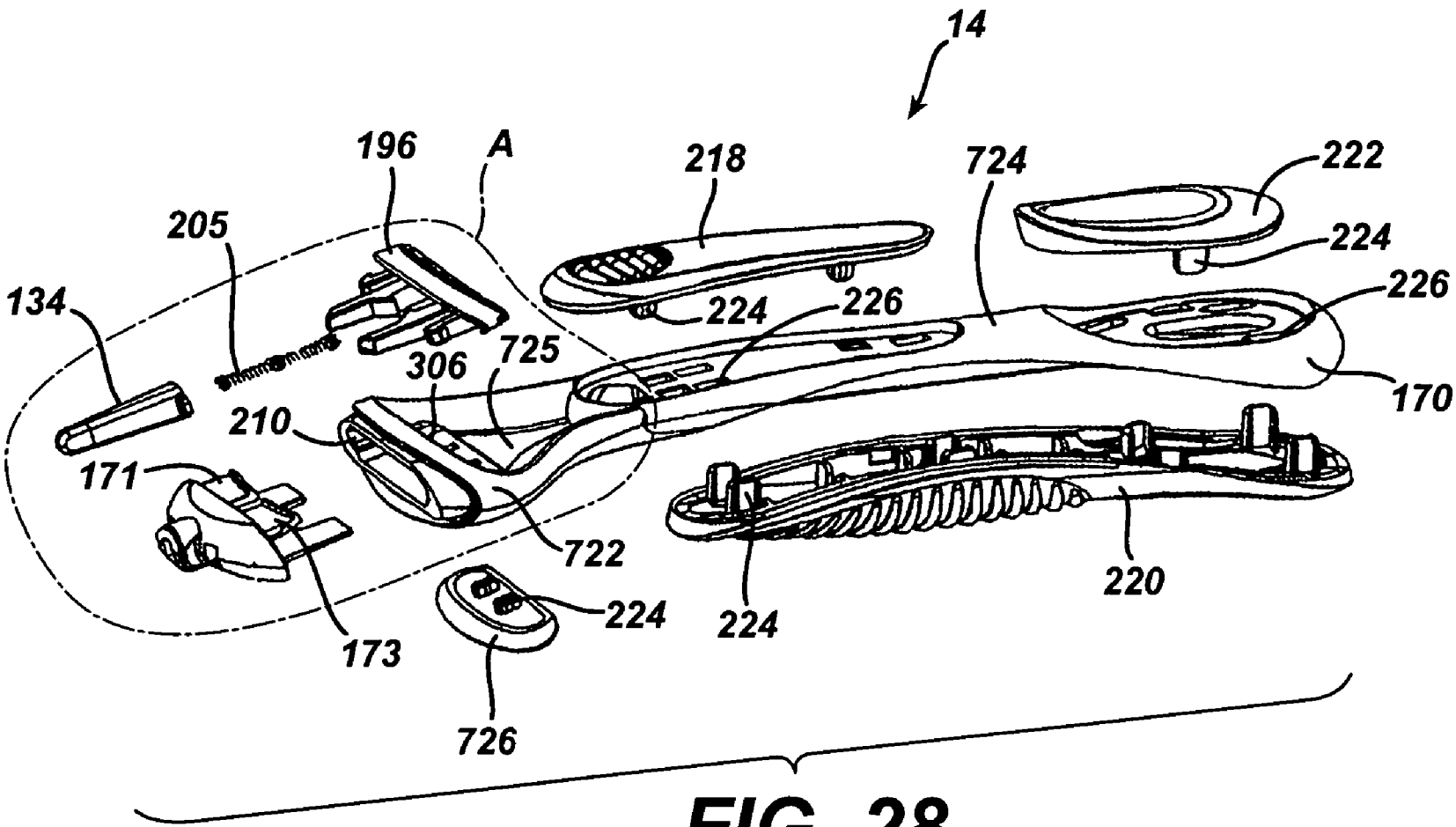
FIG. 28 is an exploded view of the handle of FIG. 2A
Figure 28A:
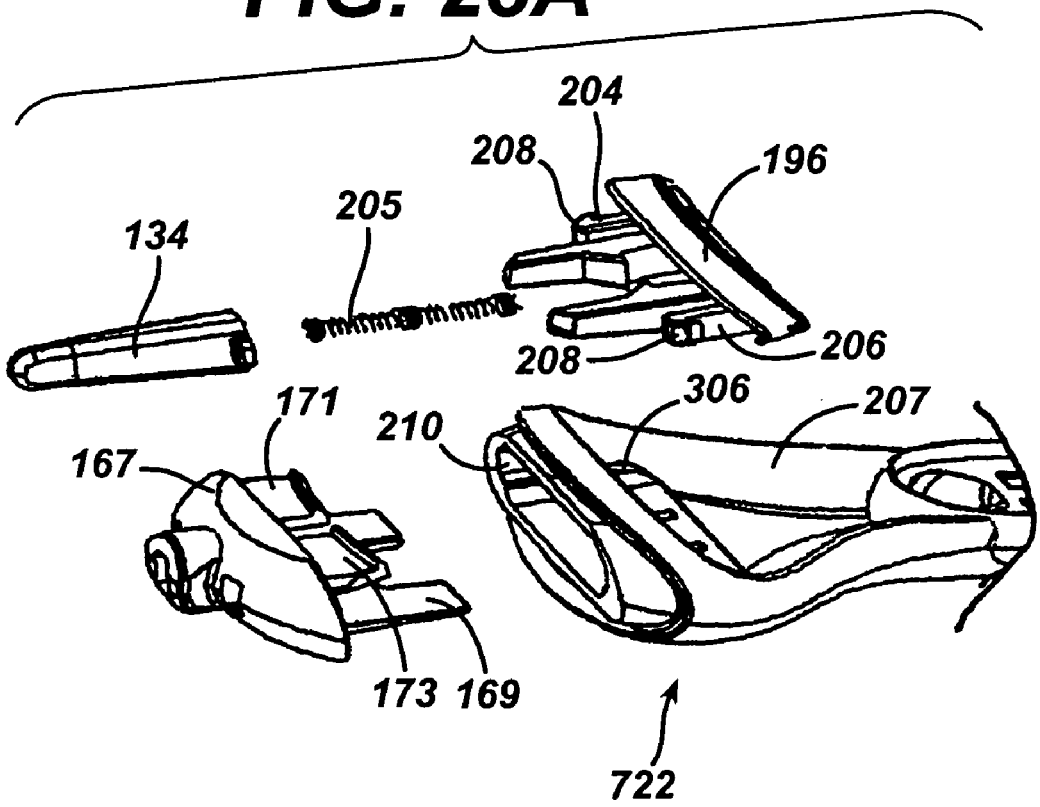
FIG. 28A is a detail view of some of the components of FIG. 28 within area A.

Referring now to FIGS. 28, 28A and 39, to assemble the handle connecting structure 11 of the handle 14, the body 167 is inserted into handle portion 722 such that latch arms 171 and 173 latch against a surface 306 (see also FIGS. 42 and 43) at portion 722 of the handle casing 170. The spring 205 is placed over the cylindrical extension 202 (FIG. 32) extending from the release button 196. The spring 205 is also inserted into cavity 139 of the plunger 134. The plunger-spring-button assembly is inserted into the rear portion of the body 167 such that the plunger 134 is received by slot 181 and the pusher arms 192 and 194 are received by slots 177 and 179, respectively (FIG. 39). Latch arms 204 and 206 of the release button 196 are set in tracks 210 of the handle casing 170.

Materials for forming the handle casing 70, body 167, connecting member 18, release button and plunger 134 can be selected as desired. Preferably, the handle casing 170 is formed of metal, such as a zinc alloy. The handle casing can, however, be formed of other materials, including plastics (e.g., plated acrylonitrile-butadiene-styrene) and plastics with metal inserts, such as those described by U.S. Pat. No. 5,822,869, incorporated by reference. Any suitable method for forming the handle casing can be employed including die casting, investment casting and molding. Suitable materials for forming the cartridge housing, rounded extension, button, connecting member and plunger include thermoplastics. For example the handle interconnect member including body 167 and protrusion 166 (FIG. 29) and plunger can be formed of acetal and the button substrate 198 including pusher arms 204, 206 and extension 202 can be formed of polypropylene. Suitable methods for forming include molding, such as injection molding.

Straight Handle

Figure 45:
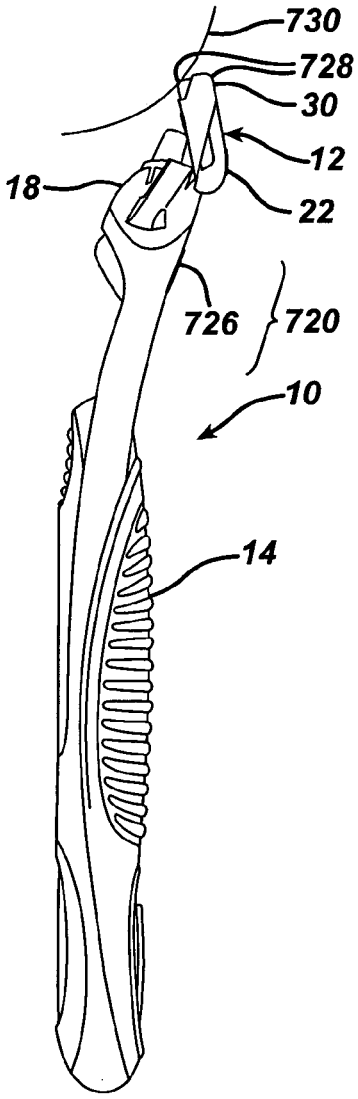
FIG. 45 is a side view of the razor of FIG. 1 weighted against skin during a trimming operation
Figure 46:
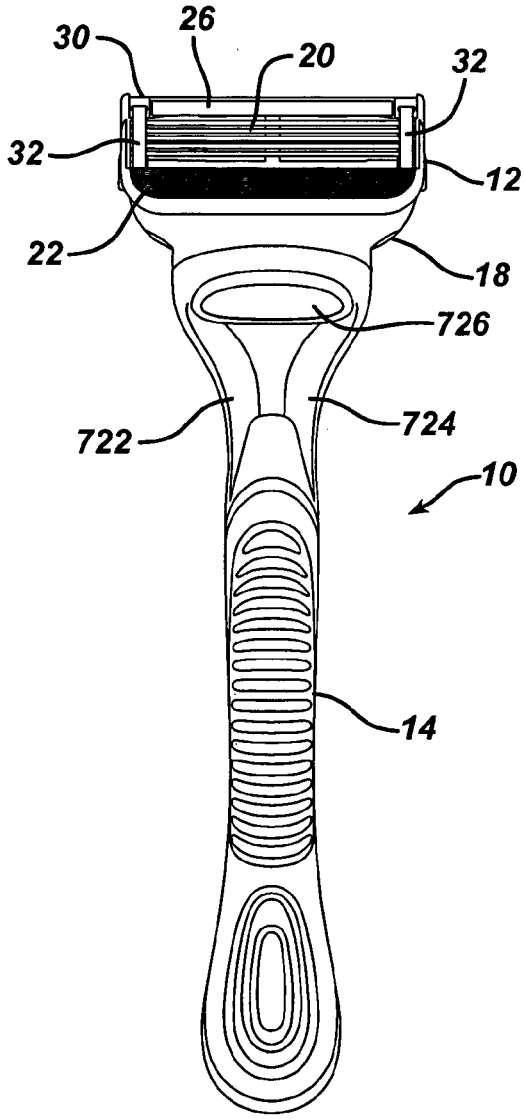
FIG. 46 is a front view of the razor of FIG. 1.

Referring to FIGS. 45 and 46, handle 14 includes a single gentle curve 720 at the end being concave on the same side as primary blades 28. Handle 14 is bifurcated into two portions 722, 724, providing an empty region between them to provide access to finger pad 726 located on the concave side of curve 720. The gentle curve 720 on the same side as the primary blades and finger pad 726 and the access to pad 726 provided by the bifurcated handle permit the user to place a thumb or finger in line with and directly under the trimming blade 504, which is located at corner 728 shown in FIG. 45, when trimming sideburns or other whiskers or hairs on user's skin 730. Finger pad 726 is made of elastomeric material and has projections to provide good engagement. The inner surfaces 732, 734 of portions 722, 724 are relieved to provide access to finger pad 726.

In use, the shaver rotates handle 14 180 degrees from the position in which it is usually gripped such that the thumb is on finger pad 726 (FIGS. 45 and 46) on the side near primary guard 22, and moves the rear of the blade unit toward skin area to be shaved with trimming blade 504 in alignment with the edge of the hairs to be trimmed, e.g., at a location desired for a clean bottom edge of side burns or an edge of a mustache or beard or under a shaver's nose when shaving hairs in this otherwise difficult-to-shave location. The blade unit 16 is located at its at-rest a stop position with respect to connecting member 18, and thus does not pivot as the user presses the rear of the blade unit 16 and cutting edge 536 against the skin and then moves it laterally over the skin to trim hairs. Cut hairs and other shaving debris that are directed to the region behind cutting edge 536 during trimming pass through debris removal passages 548 in housing 20 and aligned debris removal slots 546 in lower wall during trimming and the entire region and the debris removal passages and slots are easily cleared during rinsing in water, e.g., between shaving or trimming strokes. The cut hairs and shaving debris can also pass through passages 549 behind passages 548 and above the lower wall 512.

The recessed location of cutting edge 536 of the trimming blade 504 with respect to the rear wall 506 of the blade unit avoids cutting of a user's skin during handling of the cartridge 12 and razor 10. Including a trimming blade and a trimming guard on a common assembly that is attached to a housing of a shaving razor blade unit facilitates accurate positioning of the trimming guard with respect to the trimming blade to provide accurate trimming blade tangent angle and trimming blade span.

Other embodiments of the invention are within the scope of the appended claims.

What is claimed is:

1. A shaving assembly comprising:

a housing having a front edge and a rear edge;

one or more shaving blades between the front edge and the rear edge of the housing;

a trimming assembly including a trimming blade, the trimming assembly being a separate piece from the housing and connected to the housing; and a connecting member configured to releasably connect the housing to a razor handle, the connecting member including a deflectable element defining at least a portion of an opening extending through the connecting member, the razor handle comprises a handle interconnect member including a protrusion sized to be received by the opening wherein the protrusion has an enlarged distal end and angled side surfaces extending from the distal end to a base, the angled side surfaces have a projected apex angle of between about 45 and 60 degrees, the enlarged distal end of the protrusion having a dimension greater than a dimension of the opening such that inserting the protrusion into the opening deflects the deflectable element to secure the connecting member to the handle interconnect member.

2. The shaving assembly of claim 1, wherein the connecting member configured such that the trimming blade can be guided along a skin surface using the handle for a trimming operation.

3. The shaving assembly of claim 1, wherein the connecting member includes a pair of deflectable elements defining at least a portion of the opening.

4. The shaving assembly of claim 1, wherein the angled side surfaces have a projected apex angle of about 52 degrees.

5. The shaving assembly of claim 1 comprising a movable pusher configured to disengage the connecting member and the handle interconnect member.

6. The shaving assembly of claim 5, wherein the pusher, in an extended position, is configured to contact the connecting member to disengage the connecting member and the handle interconnecting member.

7. The shaving assembly of claim 6, wherein the pusher is configured to contact the deflectable elements to disengage the deflectable element from the side surface of the protrusion.

8. The shaving assembly of claim 1, wherein the connecting member provides pivot structure defining a pivot axis for pivoting of the housing with respect to the connecting member.

9. The shaving assembly of claim 8 comprising a plunger extending through an opening defined by the handle interconnect member.

* * * * *